US007778574B2

(12) United States Patent
Itagaki

(10) Patent No.: US 7,778,574 B2
(45) Date of Patent: Aug. 17, 2010

(54) IMAGE FORMING APPARATUS WITH AN INTERMEDIARY TRANSFER BELT HAVING A REFERENTIAL MARK

(75) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 75 days.

(21) Appl. No.: 12/106,692

(22) Filed: Apr. 21, 2008

(65) Prior Publication Data

US 2008/0292339 A1 Nov. 27, 2008

(30) Foreign Application Priority Data

Apr. 23, 2007 (JP) ..... 2007-113188

(51) Int. Cl.
*G03G 15/00* (2006.01)

(52) U.S. Cl. ..... 399/162; 399/301; 399/302

(58) Field of Classification Search ..... 399/162, 399/301, 302, 303, 308, 313, 49, 109
See application file for complete search history.

(56) References Cited

U.S. PATENT DOCUMENTS 6,141,522 A * 10/2000 Tsuruoka et al. ..... 399/302
7,099,614 B2 8/2006 Koizumi ..... 399/301
7,133,627 B2 * 11/2006 Nishizaki ..... 399/167
7,277,662 B2 10/2007 Sawai et al. ..... 399/167

FOREIGN PATENT DOCUMENTS

| | | | |
|---|---|---|---|
| JP | 07-309414 A | * | 11/1995 |
| JP | 10-39712 A | | 2/1998 |
| JP | 2003-128292 A | * | 5/2003 |
| JP | 2006-11003 A | | 1/2006 |
| JP | 2006-119541 A | | 5/2006 |
| JP | 2006-162745 A | | 6/2006 |
| JP | 2001-201904 A | | 7/2007 |

* cited by examiner

*Primary Examiner*—Sophia S Chen
(74) *Attorney, Agent, or Firm*—Fitzpatrick, Cella, Harper & Scinto

(57) ABSTRACT

An image forming apparatus includes an image bearing member for carrying a toner image; a toner image forming device for forming a toner image on the image bearing member; a detector for optically detecting a mark bonded on the image bearing member; an adjusting for adjusting the toner image forming device on the basis of an output of the detector; a protection sheet removably adhered to the mark, the protection sheet being capable of passing detecting light, wherein an adhesion of the protection sheet to the mark is smaller than an adhesion of the mark to an image bearing member.

48 Claims, 17 Drawing Sheets

(a) MOD.2

(b) MOD.3

(c) MOD.4

(d) MOD.5

(e) MOD.6

IMAGE FORMING APPARATUS WITH AN INTERMEDIARY TRANSFER BELT HAVING A REFERENTIAL MARK

FIELD OF THE INVENTION AND RELATED ART

The present invention relates to the structure of an optically detectable mark with which an intermediary transfer member, a recording medium conveying member, or the like, is provided.

Japanese Laid-open Patent Application 2006-162745 discloses an image forming apparatus which employs an intermediary transfer member supported by multiple rotational members. This intermediary transfer member is provided with a referential mark (HP mark), which shows the home position of the intermediary transfer member in terms of the circular movement of the intermediary transfer member. More specifically, as the intermediary transfer member is circularly moved, the HP mark is detected by an optical sensor to set the timing with which the exposure of the photosensitive drum is to be started. As the HP mark is detected, the optical sensor outputs a referential signal (ITOP), which sets the timing with which the writing of a latent image by a beam of laser light is to begin, preventing thereby monochromatic toner images from failing to precisely align as they are transferred onto the intermediary transfer member. That is, the image formation timing and recording medium conveyance timing are adjusted in response to the referential signal (ITOP). Therefore, toner images are precisely transferred onto a preset area of recording medium.

Japanese Laid-open Patent Application 2006-119541 discloses an image forming apparatus of the tandem type, that is, an image forming apparatus in which cyan, magenta, yellow, and black image forming portions are aligned in tandem in a straight line in the immediate adjacencies of the straight portion of its intermediary transfer belt. In the case of this image forming apparatus, the cyan, magenta, yellow, and black monochromatic images formed in the corresponding image forming portions, are sequentially transferred (primary transfer) onto the intermediary transfer belt, and then, the four layers of a toner image are transferred together (secondary transfer) onto the recording medium.

Further, Japanese Laid-open Patent Application 2001-201904 discloses an image forming apparatus having a sensor for detecting a toner image on the intermediary transfer member. The intermediary transfer member of this image forming apparatus is provided with multiple protective sheets, which are removably pasted in layers on the surface of the intermediary transfer member, which faces the sensor.

However, in a case where the protective sheet disclosed in Japanese Laid-open Patent Application 2001-201904 was placed on the optically detectable mark pasted on the intermediary transfer member, a problem occurred; the optically detectable mark came off with the protective sheet when the protective sheet was peeled.

SUMMARY OF THE INVENTION

The present invention was made in consideration of the above-described problem. Thus, the primary object of the present invention is to prevent the problem that when a protective sheet on an optically detectable mark is peeled, the optically detectable mark is peeled with the protective sheet.

According to an aspect of the present invention, there is provided an image forming apparatus comprising an image bearing member for carrying a toner image; toner image forming means for forming a toner image on said image bearing member; detecting means for optically detecting a mark bonded on said image bearing member; adjusting means for adjusting said toner image forming means on the basis of a output of said detecting means; a protection sheet removably adhered to the mark, the protection sheet being capable of passing detecting light of said detecting means, wherein an adhesion of said protection sheet to said mark is smaller than an adhesion of said mark to image bearing member.

According to another aspect of the present invention, there is provided an image forming apparatus comprising an image bearing member for carrying a toner image; toner image forming means for forming a toner image on said image bearing member; a first mark adhered to said image bearing member; a second mark removably adhered to said first mark; detecting means for optically detecting said first and second mark; adjusting means for adjusting said toner image forming means on the basis of a output of said detecting means; wherein an adhesion of said second mark to said first mark is smaller than an adhesion of said first mark to said image bearing member.

According to a further aspect of the present invention, there is provided an image forming apparatus comprising an image bearing member for carrying a toner image; toner image forming means for forming a toner image on said image bearing member; detecting means for optical detecting a mark provided on said image bearing member; adjusting means for adjusting said toner image forming means on the basis of a output of said detecting means; a first protection sheet removably adhered to said mark, said first protection sheet being capable of passing a detecting light of said detecting means; a second protection sheet removably adhered to said first protection sheet, said second protection sheet being capable of passing a detecting light of said detecting means; an adhesion of said second protection sheet to said first protection sheet is smaller than an adhesion of said first protection sheet in the case of said mark.

According to a yet further aspect of the present invention, there is provided an image forming apparatus comprising an image bearing member for carrying a toner image; toner image forming means for forming a toner image on said image bearing member; a recording material carrying member for carrying a recording material; transferring means for transferring a toner image from said image bearing member to a recording material carried on said recording material carrying member; detecting means for optically detecting a mark adhered to said recording material carrying member; adjusting means for adjusting said toner image forming means on the basis of a output of said detecting means; a protection sheet removably adhered to said mark, said protection sheet being capable of passing detecting light of said detecting means, wherein an adhesion of said protection sheet to said mark is smaller than an adhesion of said mark to image bearing member.

According to a yet further aspect of the present invention, there is provided an image forming apparatus comprising an image bearing member for carrying a toner image; a recording material carrying member for carrying a recording material; transferring means for transferring a toner image from said image bearing member to a recording material carried on said recording material carrying member; a first mark bonded to said recording material carrying member; a second mark removably adhered to said first mark; detecting means for optically detecting said first and second mark; adjusting means for adjusting said toner image forming means on the basis of a output of said detecting means; wherein an adhesion of said second mark relating to said first mark is smaller than an adhesion of said first mark to said recording material carrying member.

According to a yet further aspect of the present invention, there is provided an image forming apparatus comprising an image bearing member for carrying a toner image; a recording material carrying member for carrying a recording material; transferring means for transferring a toner image from said image bearing member to a recording material carried on said recording material carrying member; detecting means for optically detecting a mark provided on said recording material carrying member; adjusting means for adjusting said toner image forming means on the basis of a output of said detecting means; a first protection sheet removably bonded to said mark, said first protection sheet being capable of passing detecting light of said detecting means; a second protection sheet removably bonded to said first protection sheet, said second protection sheet being capable of passing the detecting light of said detecting means, wherein an adhesion of said second protection sheet to said first protection sheet is smaller than an adhesion of said first protection sheet to said mark.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a few of the preferred embodiments of the present invention will be described in detail with reference to the appended drawings. The following preferred embodiments are not intended to limit the present invention in application. That is, the present invention is also applicable to any image forming apparatus which may be partially or entirely different in structure from those in the following embodiments, as long as the image forming apparatus is structured to optically detect the referential mark with which the circularly moving member thereof is provided.

For example, the present invention is applicable to an image forming apparatus of the tandem type, that is, an image forming apparatus in which multiple image formation units are aligned in tandem along the intermediary transfer belt or recording medium conveying belt of the image forming apparatus.

The following descriptions of the preferred embodiments of the present invention concern only the essential portions of an image forming apparatus, which are directly involved in the formation of a toner image. However, the present invention is also applicable to various apparatuses, such as a printer, a copying machine, a facsimile machine, a multifunction printer, etc., which are made up of additional devices (equipment), housing, etc., in addition to the above-mentioned essential portions.

The drawings of the image forming apparatuses disclosed in Japanese Laid-open Patent Applications 2006-162745, 2006-119541, and 2001-201904, will not be provided. Further, in order to avoid the repetition of the same descriptions, the description of the general subjects, such as the structure, electric power source, various apparatuses and devices of the image forming apparatuses, controls of the apparatuses, etc., will not be repeated unless necessary.

Embodiment

Figure 1:
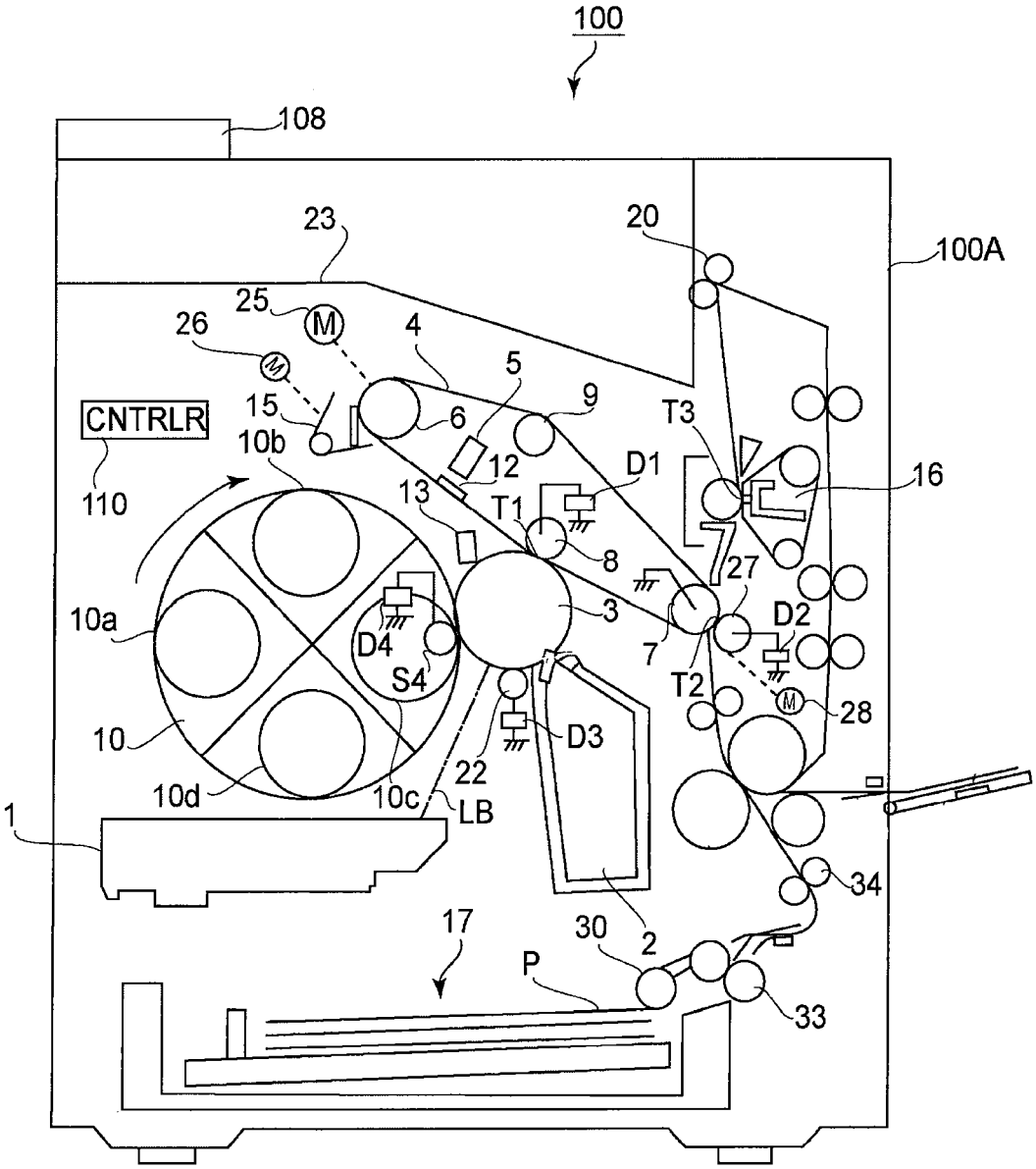
FIG. 1 is a schematic sectional view of the image forming apparatus in the first embodiment of the present invention, showing the general structure of the apparatus.
Figure 2:
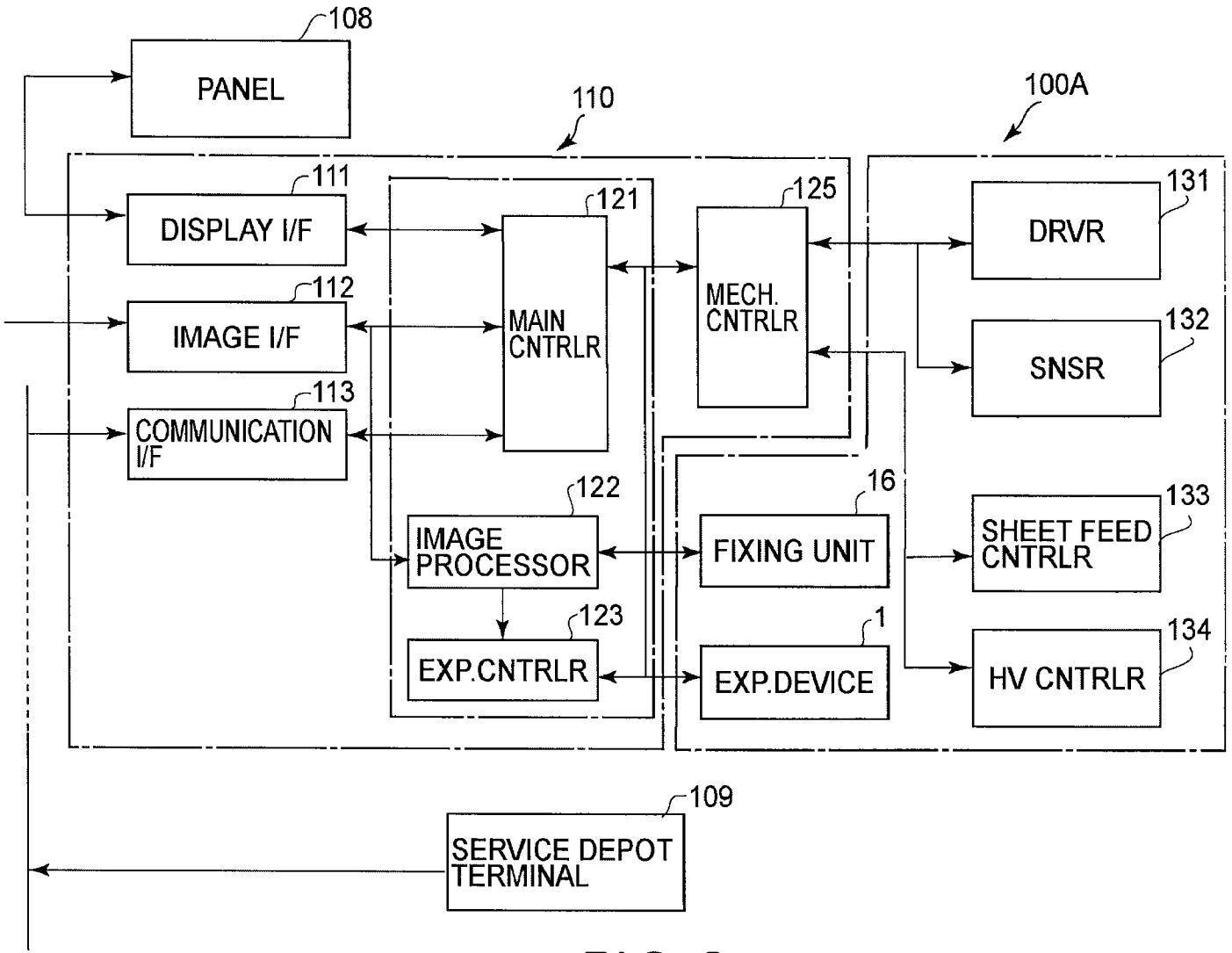
FIG. 2 is a block diagram of the control portion of the image forming apparatus in the first embodiment, showing the connections thereof.

FIG. 1 is a schematic sectional view of the image forming apparatus in the first embodiment of the present invention. FIG. 2 is a block diagram of the control portion and various componential units and portions of the image forming apparatus, and shows the connections among the control portions, various componential units, and other portions of the image forming apparatus. The image forming apparatus 100 in the first embodiment is an electrophotographic full-color laser printer, which employs an intermediary transfer belt 4.

Referring to FIG. 1, the image forming apparatus 100, which is an example of an image forming apparatus, has the intermediary transfer belt 4, which is an example of an image bearing member. The intermediary transfer belt 4 is an endless belt, which is 500 mm in circumferential length. It is supported by four rollers 6, 7, 9, and 8 (which are rotatable members), by being stretched around the rollers. The roller 6 is a driver roller. The roller 7 is a secondary transfer roller, which is positioned inside the loop which the intermediary transfer belt 4 forms. The roller 9 is a tension roller. The roller 8 is a primary transfer roller. The intermediary transfer belt 4 is circularly driven in the counterclockwise direction of the drawing, at a process speed of 600 mm/sec, by the driver roller 6 connected to a driving mechanism 25. The intermediary transfer belt 4 is a member which is required to be specific in electrical resistance, surface properties, thickness, etc., being therefore high in manufacturing cost.

The intermediary transfer belt 4 and primary transfer roller 8 are positioned so that the primary transfer roller 8 opposes a photosensitive drum 3 with the presence of the intermediary transfer belt 4 between the primary roller 8 and photosensitive drum 3. The photosensitive drum 3 is made up of an aluminum cylinder with a diameter of 60 mm, and a layer of organic photoconductor (OPC) coated on the peripheral surface of the aluminum cylinder. The end portions of the photosensitive drum 3, in terms of the direction parallel to the axial line of the photosensitive drum 3, are supported by a pair of flanges, one for one, so that the photosensitive drum 3 is rotatable. In order to rotationally drive the photosensitive drum 3, driving force is transmitted to one of the lengthwise end portions of the photosensitive drum 3 from the aforementioned driving mechanism 25. The photosensitive drum 3 rotates in the clockwise direction of the drawing, at a peripheral velocity, which is roughly the same as the speed at which the intermediary transfer belt 4 is circularly driven.

The image forming apparatus 100 has a primary charging device 22, an exposing apparatus 1, a rotary developing device 10, the primary transfer roller 8, a drum cleaning apparatus 2, and a density sensor 13, which are disposed in the adjacencies of the peripheral surface of the photosensitive drum 3 in a manner to surround the peripheral surface of the photosensitive drum 3. The density sensor 13 detects the density (amount of coloring agents) of the visible image formed on the photosensitive drum 3.

The primary charging device 22 is provided with an electrically conductive roller, which is kept in contact with the peripheral surface of the photosensitive drum 3 with the use of an unshown mechanism made up of springs or the like. To the electrically conductive roller, negative charge voltage, which is a combination of DC and AC voltages, is applied from an electric power source D3. As the negative charge voltage is applied to the electrically conductive roller, the peripheral surface of the photosensitive drum 3 is uniformly charged to a preset potential level.

The exposing apparatus 1 (laser scanner) is made up of a semiconductor laser element, and a rotatable mirror. In operation, it outputs a beam of laser light LB from its semiconductor laser element, while modulating the beam of laser light LB with pictorial signals, in such a manner that the beam of laser light LB is reflected by the rotating minor in a manner to scan the peripheral surface of the photosensitive drum 3 in the direction parallel to the axial line of the photosensitive drum 3. As a result, the numerous points of the charged peripheral surface of the photosensitive drum 3 are exposed, reducing thereby potential, effecting an electrostatic image, which is lower in potential at the points to which toner is to adhere. In a case where a full-color image is to be formed, the above-described process is repeated four times, which corresponds to the number of monochromatic images, different in color, into which an optical image of the image to be formed is separated for image formation.

The rotary developing device 10 is made up of a yellow developing device 10*a*, a magenta developing device 10*b*, a cyan developing device 10*c*, and a black developing device 10*d*, and a rotary by which the preceding developing devices 10*a*, 10*b*, 10*c*, and 10*d* are held in such a manner that each of the developing devices can be moved into the position in which it opposes the photosensitive drum 3.

The yellow developing device 10*a* has a development sleeve S4, on the peripheral surface of which charged yellow toner is to be borne. The development sleeve S4 is in the form of a cylinder, and is positioned so that there is a minute gap between the peripheral surface of the development sleeve S4 and the peripheral surface of the photosensitive drum 3. It is rotated while bearing the charged yellow toner. To the development sleeve S4, development voltage is applied from an electric power source D4. The development voltage is a combination of DC and AC voltages. The potential of the DC voltage is set to the middle level between the potential level to which the peripheral surface of the photosensitive drum 3 is charged, and the potential level of the exposed point of the peripheral surface of the photosensitive drum 3. As the development voltage is applied to the development sleeve S4, toner is adhered to the exposed points of the peripheral surface of the photosensitive drum 3 (electrostatic image is reversely developed), effecting thereby a yellow toner image, that is, a visible image formed of yellow toner. The magenta developing device 10*b*, cyan developing device 10*c*, and black developing device 10*d* form magenta, cyan, and black toner images, using magenta, cyan, and black toners, respectively.

The primary transfer roller 8 is kept pressed against the peripheral surface of the photosensitive drum 3 with the intermediary transfer belt 4 placed between the primary transfer roller 8 and photosensitive drum 3, forming thereby a primary transferring portion T1 between the photosensitive drum 3 and intermediary transfer belt 4. To the primary transfer roll 8, positive DC voltage is applied from an electric power source D1. As the positive DC voltage is applied to the primary roller 8, the toner image (negative in polarity) on the photosensitive drum 3 is transferred onto the intermediary transfer belt 4. The transfer residual toner, that is, the toner remaining on the photosensitive drum 3 after being moved through the primary transfer portion T1, is removed by the drum cleaning apparatus 2.

The image forming apparatus 100 is also provided with a secondary transfer roller 27 (which is placed on an outward side of the loop of intermediary transfer belt 4, being therefore outside the transfer roller) and a belt cleaning apparatus 15, which are positioned in the adjacencies of the outward surface of the intermediary transfer belt 4. The secondary transfer roller 27 and belt cleaning apparatus 15 can be placed in contact, or separated from, the intermediary transfer belt 4, by driving mechanisms 28 and 26, respectively. While yellow, magenta, cyan, and black toner images are sequentially transferred (primary transfer) in layers onto the intermediary transfer belt 4, the secondary transfer roller 27 and belt cleaning apparatus 15 are kept separated from the intermediary transfer belt 4. As soon as the transfer of the four toner images, different in color, onto the intermediary transfer belt 4 is completed, the secondary transfer roller 27 is placed in contact with the intermediary transfer belt 4 to transfer together (secondary transfer) the four toner images, different in color, onto a sheet of recording medium P (which hereafter will be referred to simply as recording medium P).

The secondary transfer roller 27, that is, outside secondary transfer roller, is pressed against the secondary transfer roller 7, that is, inside secondary transfer roller, with the intermediary transfer belt 4 placed between the secondary transfer rollers 27 and 7, forming thereby a secondary transfer portion T2 between the secondary transfer roller 27 and intermediary transfer belt 4. The inside secondary transfer roller 7 is grounded, and the outside secondary transfer roller 27 is connected to an electric power source D2. The recording medium P is delivered to the secondary transfer portion T2 in synchronism with the arrival of the layered toner images on the intermediary transfer belt 4 at the secondary transfer portion T2.

To the outside secondary transfer roller 27, positive DC voltage is applied from an electric power source D2. As the positive DC voltage is applied to the outside secondary transfer roller 27, the layered negative toner images on the intermediary transfer belt 4 are moved onto the recording medium P. The transfer residual toner, that is, the toner remaining on the intermediary transfer belt 4 after being moved through the secondary transfer portion T2, is removed by the belt cleaning apparatus 15.

Referring to FIG. 2, the main assembly 100A of the image forming apparatus 100 is controlled by a control portion 110, which is made up of a display interface 111, an image data interface 112, a communication interface 113, a CPU 121 (main controller), and a CPU 125 (mechanism control portion). The CPU 121 is a computer made up of an HDD, ROMs, and RAMs, etc. It is also provided with an image processing portion 122 (which is independent computation circuit), and an exposure control portion 123. The CPU 121 (main control) coordinately controls various portions of the apparatus main assembly 100A, based on the processing programs installed in the CPU, and also, controls the CPU 125 (mechanism control), which is a subordinate control unit to the CPU 121.

The apparatus main assembly 100A is provided with a driving portion 131, which is made up of a motor, a clutch, a fan, etc. The driving portion 131 drives the driving mechanisms 25, 26, 28, etc., shown in FIG. 1. The sensor portion 132 has a temperature sensor, a humidity sensor, a toner remainder amount sensor, a recording medium position sensor, an HP sensor 5, etc.

A paper feed control portion 133 operates a pickup roller 30, a separation roller 33, etc., to feed the recording medium P into the apparatus main assembly 100A. A high voltage control portion 134 controls the electric power sources D1, D2, D3 and D4 to control the amount by which the photosensitive drum 3 receives electrical charge, the voltage applied to the primary transfer roller 8, etc.

The pictorial data interface 112 inputs the pictorial data (for example, data written in page description language) sent from a PC (personal computer) or other controllers, etc. It also inputs pictorial data in the form of PDF, Tiff, etc. The image processing portion 122 creates data for forming each of the monochromatic images which correspond to the monochromatic optical images of the primary colors, one for one, into which the optical image of an intended image, from the inputted pictorial data. Then, it subjects the thus created data to the γ-compensation or the like process, and develops the created data into data corresponding scanning lines. The exposure control portion 123 controls the amount by which a given point of the peripheral surface of the photosensitive drum 3 is exposed by the beam of laser light, and the length of time the beam of laser light is emitted; it generates the signals for driving the laser beam emitting portion of the exposing apparatus. In other words, it controls the operation of the exposing apparatus 1 following the instructions from the CPU 121 (main control).

The display interface 111 controls the data entry and data output through a display/control touch panel 108. A communication interface 113 is in connection with the service point terminal 109 through a network.

Referring to FIG. 1, as an image formation job is inputted, the control portion 110 begins to control the image forming apparatus 100 to carry out the following image formation steps. That is, first, the image forming apparatus 100 uniformly charges the peripheral surface of the photosensitive drum 3 by the primary charging device 22. Then, as soon as the HP mark 12 is detected by the HP sensor 5, the image forming apparatus 100 begins the exposure process. The exposing apparatus 1 forms an electrostatic image on the peripheral surface of the photosensitive drum 3 by being driven by the pictorial signals derived from the monochromatic image of yellow color, that is, one of the primary colors into which the optical image of an original (intended image) has been separated. Then, the yellow developing device 10*a* deposits yellow toner to the electrostatic image; it develops the electrostatic latent image into a yellow toner image. The yellow toner image is moved through the primary transfer portion T1 by the rotation of the photosensitive drum 3, while being transferred (primary transfer) onto the intermediary transfer belt 4 with the use of the primary transfer roller 8.

While the yellow toner image on the intermediary transfer belt 4 is conveyed back to the primary transfer portion T1 by the circular movement of the intermediary transfer belt 4, a magenta toner image is formed on the peripheral surface of the photosensitive drum 3 through the steps similar to the above-mentioned steps for forming the yellow toner image. Then, the magenta toner image is transferred (primary transfer) onto the intermediary transfer belt 4 so that it is layered on the yellow toner image on the intermediary transfer belt 4. Then, a cyan toner image is formed on the peripheral surface of the photosensitive drum 3 through the steps similar to the above-mentioned steps for forming the yellow, and magenta toner images, and is transferred (primary transfer) onto the intermediary transfer belt so that it is layered on the yellow and magenta images on the intermediary transfer belt 4. Further, a black toner image is formed, and transferred (primary transfer) onto the intermediary transfer belt 4 so that it is layered on the yellow, magenta, and cyan toner images on the intermediary transfer belt 4. The transfer of the four toner images, different in color, onto the intermediary transfer belt 4 in such a manner that they align on the intermediary transfer belt 4 is controlled with reference to the position of the HP mark 12, which is detected by the HP sensor 5.

The recording mediums P in a recording medium storage cassette 17 are fed one by one into the apparatus main assembly 100A by the pickup roller 30 and a pair of separation rollers 33, and are kept on standby by a pair of registration roller 34. The registration rollers 34 send the recording medium P toward the secondary transfer portion T2 with such timing that the recording medium P arrives at the second transfer portion T2 at the same time as the layered combination of the four toner images, different in color, on the intermediary transfer belt 4 arrives at the second transfer portion T2. Then, the recording medium P is conveyed through the secondary transfer portion T2, remaining on the intermediary transfer belt 4. While the recording medium P is conveyed through the second transfer portion T2, the four toner images, different in color, are transferred together (secondary transfer) onto the recording medium P.

After being conveyed through the secondary transfer portion T2, the recording medium P is conveyed to a fixing unit 16. In the fixing unit 16, the recording medium P and the toner images thereon are subjected to heat and pressure by the fixing portion T3 of the fixing unit 16. As a result, the four toner images, which effect a single full-color image, become fixed to the surface of the recording medium P. Then, the recording medium P is discharged onto a delivery tray 23 by a pair of discharge rollers 20. The transfer residual toner, that is, the toner remaining on the intermediary transfer belt 4 after the secondary transfer, is removed by the belt cleaning apparatus 15, which is in contact with the intermediary transfer belt 4.

<HP Sensor and HP Mark>

Figure 3:
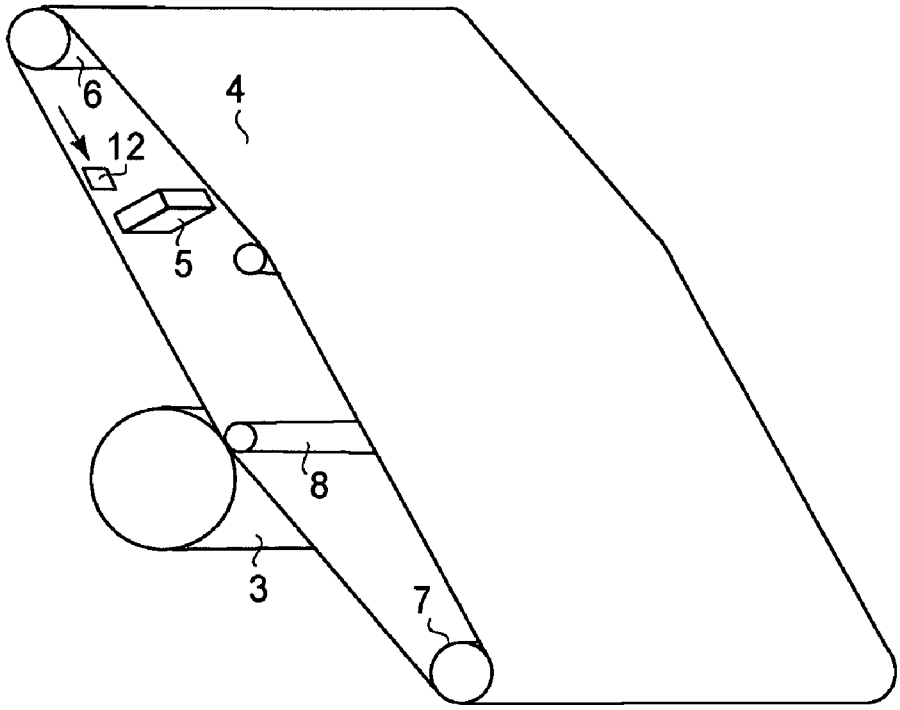
FIG. 3 is a schematic perspective view of the intermediary transfer member, showing the positioning of the HP mark and HP sensor.
Figure 4:
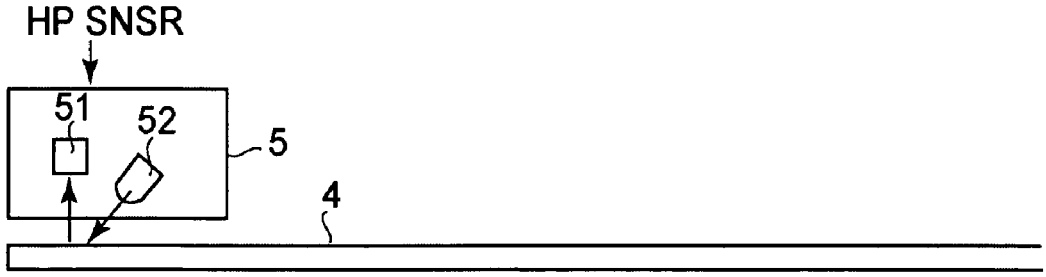
FIG. 4 is a schematic drawing of the combination of the HP sensor and intermediary transfer belt 4, showing the structure of the HP sensor.
Figure 5:
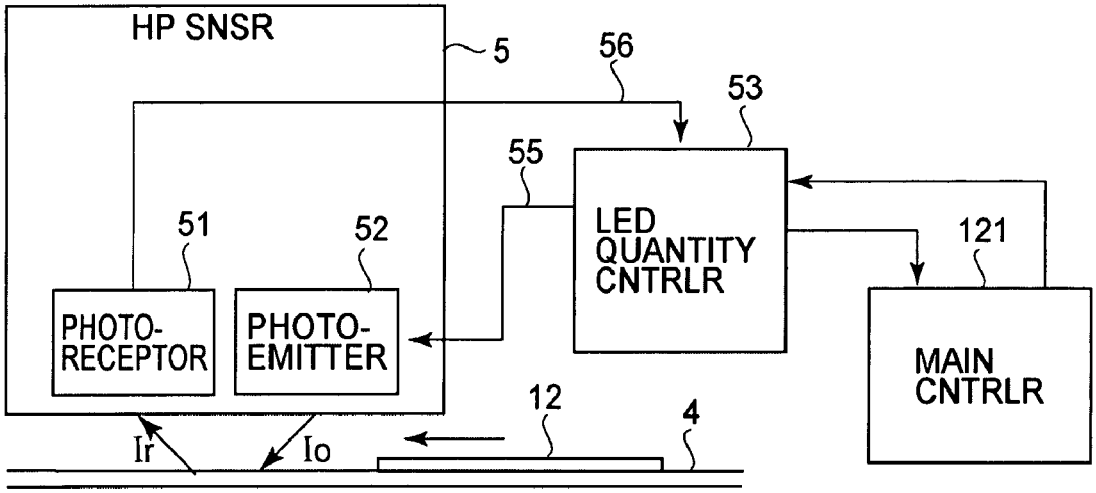
FIG. 5 is a block diagram of the control of the HP sensor.
Figure 6:
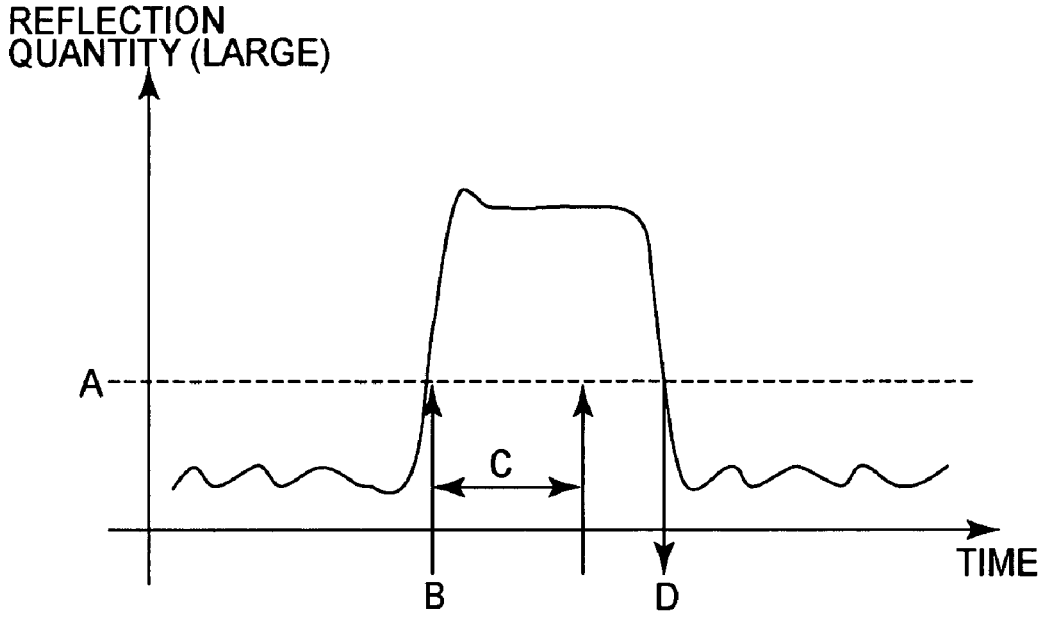
FIG. 6 is a graph of the HP sensor output relative to the elapsed time.
Figure 7:
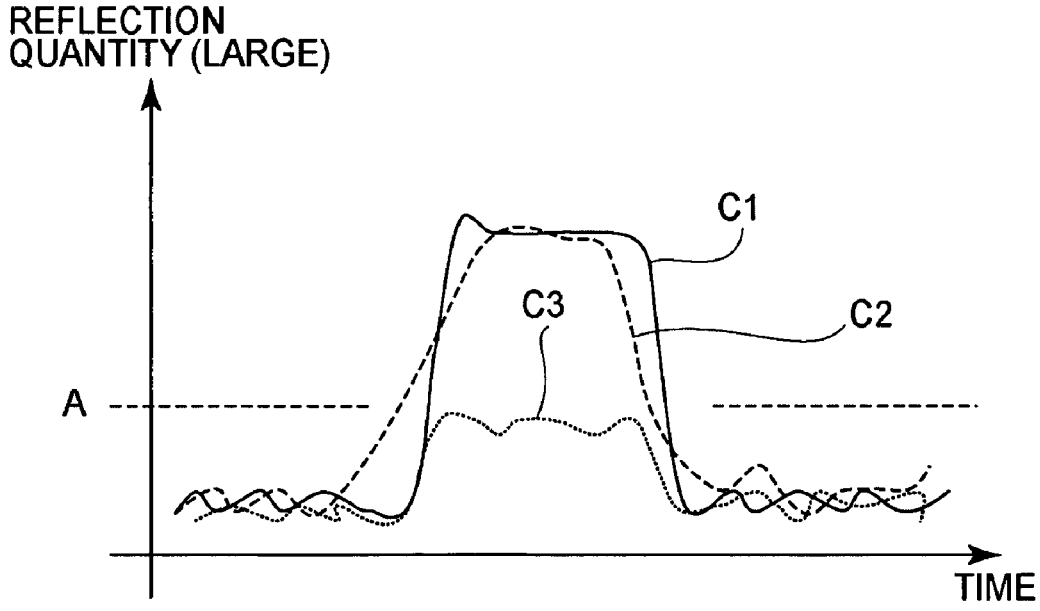
FIG. 7 is a graph of the output of the HP sensor, the HP mark of which has worn, relative to the elapsed time.

FIG. 3 is a perspective view of the intermediary transfer belt 4 and photosensitive drum 3, showing the positioning of the HP mark and HP sensor. FIG. 4 is a schematic drawing of the HP sensor and intermediary transfer belt 4, showing the structure of the HP sensor. FIG. 5 is a block diagram of the control sequence for the HP sensor. FIG. 6 is a graph of the HP sensor output relative to the elapsed time. FIG. 7 is a graph of the output of the HP sensor, the HP mark of which has worn, relative to the elapsed time.

Referring to FIG. 3, the intermediary transfer belt 4, which is supported and stretched by the driver roller 6, secondary transfer roller 7, primary transfer roller 8, etc., is provided with an HP mark 12, which is on the inward surface of the intermediary transfer belt 4. The HP mark 12 is in the form of a 10 mm square. The most inward layer of the intermediary transfer belt 4 is formed of blackened PI (polyimide). Thus, the inward surface of the intermediary transfer belt 4 is black. The HP mark 12 is a piece of polyethylene film given white color.

The HP sensor 5 is positioned so that it faces the inward surface of the intermediary transfer belt 4. It optically detects the difference between the white of the HP mark and the black of the intermediary transfer belt 4. The exposure timing of the photosensitive drum 3 is controlled based on the results of the detection of the above-mentioned difference by the HP sensor 5.

Referring to FIG. 4, the intermediary transfer belt 4 moves in the back-to-front direction of the paper on which FIG. 4 is drawn. The HP sensor 5 is positioned so that it faces one of the edge portions of the intermediary transfer belt 4. The HP sensor 5 made up of a light emitting portion 52, such as an LED (light emitting diode), and a light receiving portion 51, such as a photo-detector. In operation, the LED of the HP sensor 5 emits a beam of light toward the inward surface of the intermediary transfer belt 4, and the light receiving portion of the sensor 5 detects the portion of the beam of light, which is reflected by the inward surface of the intermediary transfer belt 4. The role of the HP sensor 5 is to detect the optical contrast between the white and black areas. Thus, as for the positional relationship between the light emitting portion 52 and light receiving portion 51 in terms of the angle between the optical axis of the light emitting portion and the optical axis of the light receiving portion, the light emitting portion 52 and light receiving portion 51 are not positioned so that the latter receives the regular reflection of the beam of light emitted by the former, that is, the portion of the beam of light, which was mirror-reflected by the inward surface of the intermediary transfer belt 4, but, are positioned so that the latter receives the portion of the beam of light emitted from the light emitting portion, which was diffused (scattered) by the inward surface of the intermediary transfer belt 4.

Next, referring to FIG. 5, a beam of light Io emitted toward the intermediary transfer belt 4 from the light emitting portion 52 of the HP sensor 5 is reflected by the inward surface of the intermediary transfer belt 4, partially turning into a reflected beam of light Ir. The reflected beam of light Ir is received by the light receiving portion 51. As the light receiving portion 51 receives the reflected beam of light Ir, it outputs a signal showing the amount 56 of the reflected light. The inward surface of the intermediary transfer belt 4 is provided with the HP mark 12. Thus, as the intermediary transfer belt 4 moves, the HP mark 12 eventually faces the HP sensor 5, changing thereby the amount 56 by which the beam of light emitted by the light emitting portion 52 is reflected by the inward side of the intermediary transfer belt 4.

A control portion 53 for controlling the amount by which the LED emits light monitors the amount 56 (measured amount) of the reflected light Ir, which is measured by the light receiving portion 51. Then, the control portion 53 informs the CPU 121 (main control) of the detected amount 56 of the reflected light Ir. Then, the control portion 53 adjusts in intensity the beam of light Io; it adjusts the light emitting portion 52, in the intensity at which the light emitting portion 52 emits the beam of light Io, to the level set by the CPU 121 (main control).

The CPU 121 (main control) detects the passage of the HP mark 12 based on the intensity 55 of the emitted beam of light Io and the amount 56 (measured value) of the reflected light Ir. Then, it controls the timing with which the writing of an electrostatic image on the peripheral surface of the photosensitive drum 3 (FIG. 1) is to be started.

Then, the CPU 121 (main control) activates the driving portion 131 and high voltage control portion 134 through the CPU 125 (mechanical control), as well as the exposure control portion 123, etc., based on the set writing start timing, as shown in FIG. 2.

As the HP sensor 5 detects the HP mark 12, the amount 56 by which the light receiving portion 52 receives the reflected light changes as shown in FIG. 6. The inward surface of the intermediary transfer belt 4 is black. Thus, while the HP sensor 5 is facing the area of the inward surface of the intermediary transfer belt 4, which is not covered with the HP mark 12, the amount 56 by which the light receiving portion 52 receives the reflected light is small, although it varies according to the state of the area in terms of reflectivity. Then, as soon as the HP mark 12 begins to move across the HP sensor 5, the amount 56 of the reflected light begins to suddenly increase, because the HP mark 12 is white.

The CPU 121 (main control) stores the point B in time at which the amount 56 by which the light receiving portion 52 received the reflected light exceeded a preset value (threshold value A). Then, it begins to count the length of time having elapsed since the point B in time. If the length of time the amount 56 by which the light receiving portion receives the reflected light remained above the threshold value A exceeded a preset length C of time, the CPU 121 (main control) determines that the HP mark 12 is moving across the HP sensor 5. Then, it instructs the image forming apparatus to start image formation at the point D in time when it detects that the amount 56 by which the light receiving portion 52 receives the reflected light falls below the threshold value A.

The reason why the preset length C of time is used to determine whether or not the HP mark 12 is moving in front of the HP sensor 5 is as follows. That is, even if the amount 56 by which the light receiving portion 52 receives the reflected light exceeds the threshold value A because of the adhesion of foreign matter to the inward surface of the intermediary transfer belt 4, and/or staining of the inward surface of the intermediary transfer belt 4, there is little chance that the length of time the amount 56 by which the light receiving portion 52 receives the reflected light remains above the threshold value A lasts longer than the preset length C of time. In other words, using the preset length C of time to determine whether or not the HP mark 12 is moving in front of the HP sensor 5 can prevent the problem that the writing of an electrostatic image is started because the foreign matter, such as dust and stains, are mistaken for the HP mark 12.

However, with the increase in the amount of cumulative usage of the image forming apparatus 100, the HP mark 12 eventually wears, creating a problem. That is, as the wear of the HP mark 12 exceeds a certain level, it becomes highly possible for the CPU 121 (main control) to fail to properly set the timing for starting an image forming operation, based on the amount 56 by which the light receiving portion 52 receives the light reflected by the HP mark 12.

For example, as the HP mark 12 reduces in reflectivity due to the soiling of the entire surface of the HP mark 12, the amount 56 by which the receiving portion 52 receives the reflected light reduces, compared to the normal amount C1, as represented by a dotted line C3, making it impossible to determine whether or not the HP mark 12 is moving in front of the HP sensor, based on the threshold value A. That is, unless the amount 56 by which the light receiving portion 52 receives the reflected light exceeds the threshold value A, the CPU 121 (main control) cannot properly set the image formation start timing for each circular rotation of the intermediary transfer belt 4, displaying therefore an error message indicating that image formation is impossible.

For example, in a case where an edge portion or edge portions of the HP mark 12 are soiled or damaged, the point in time at which the HP mark 12 has begun to move in front of the HP sensor 5 is not clear cut, because the borderline between the black and white areas is not clear, as represented by a broken line C2 in FIG. 7, causing thereby the CPU 121 (main control) to set the image formation start timing differently from the timing it set when the borderline is normal as represented by the line C1, which represents the case in which the HP mark 12 is in the normal condition. More specifically, compared to the case represented by the line C1, where the HP mark 12 is in the normal condition, the timing with which the amount 56 by which the light receiving portion 52 receives the reflected light increases or decreases becomes unstable. In addition, even if it is possible for the CPU 121 (main control) to accurately detect the arrival of the HP mark 12 at the HP sensor 5, the instability in the timing with which the amount 56 increases or decreases increases the amount of error in the alignment of the toner images, different in color, which occurs when the toner images are transferred onto the intermediary transfer belt 4.

Further, in the past, whenever it became impossible for the image forming apparatus to form an image, or fail to properly align multiple monochromatic images, different in color, when transferring the images onto the intermediary transfer belt 4, a service person used to wipe the inward surface (inclusive of HP mark 12) of the intermediary transfer belt 4 with diluted ethanol to remove the adherents, such as stains, on the inward surface. If the HP mark 12 had been scarred, or had been stained too much to wipe clean with the diluted ethanol, the intermediary transfer belt 4 was replaced even when the intermediary transfer belt 4 itself was not abnormal in terms of function.

<Double Layer HP Mark>

Figure 8:
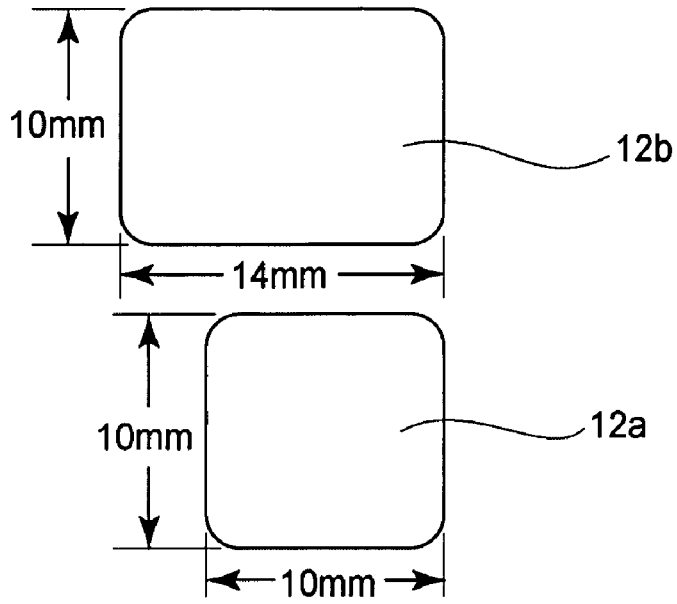
FIG. 8 is a plan view of the top and bottom layers of the HP mark.
Figure 9:
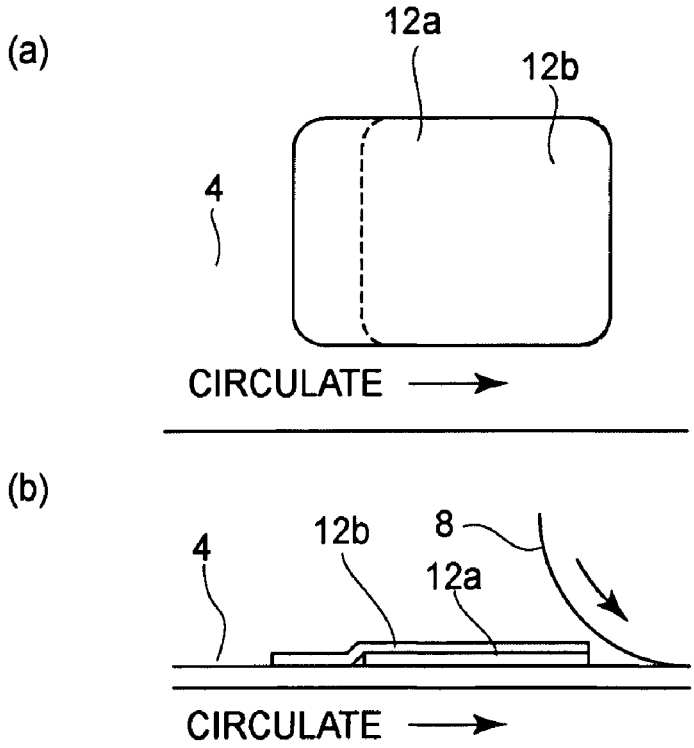
FIGS. 9(*a*) and 9(*b*) are schematic drawings of the HP mark of the double layer type, showing the structure of the HP mark.
Figure 10:
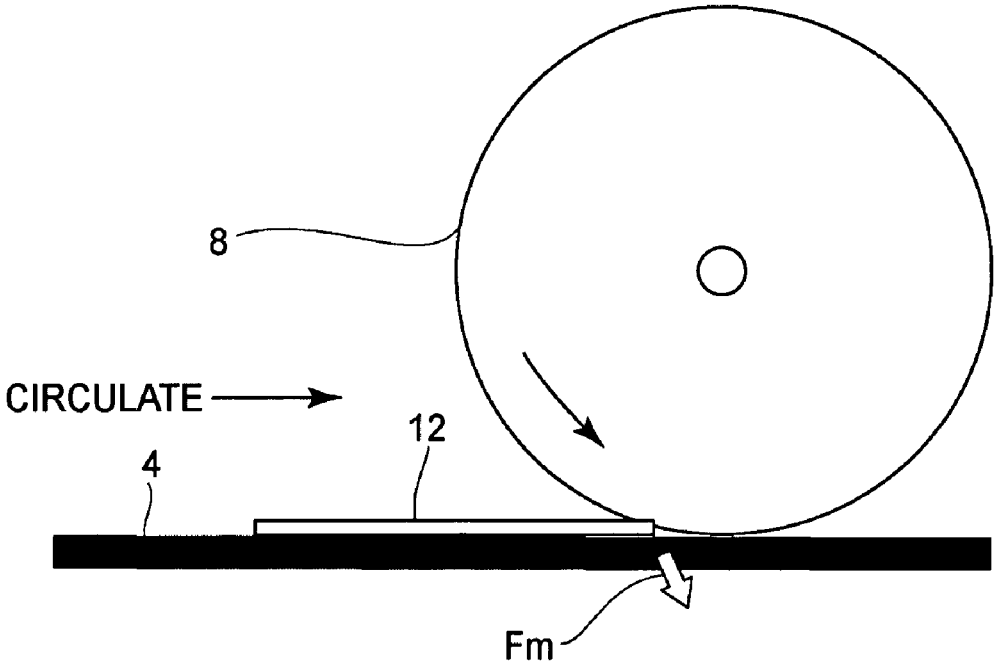
FIG. 10 is a schematic drawing showing the direction and manner in which the HP mark enters the area of contact between the primary transfer roller and intermediary transfer belt.
Figure 11:
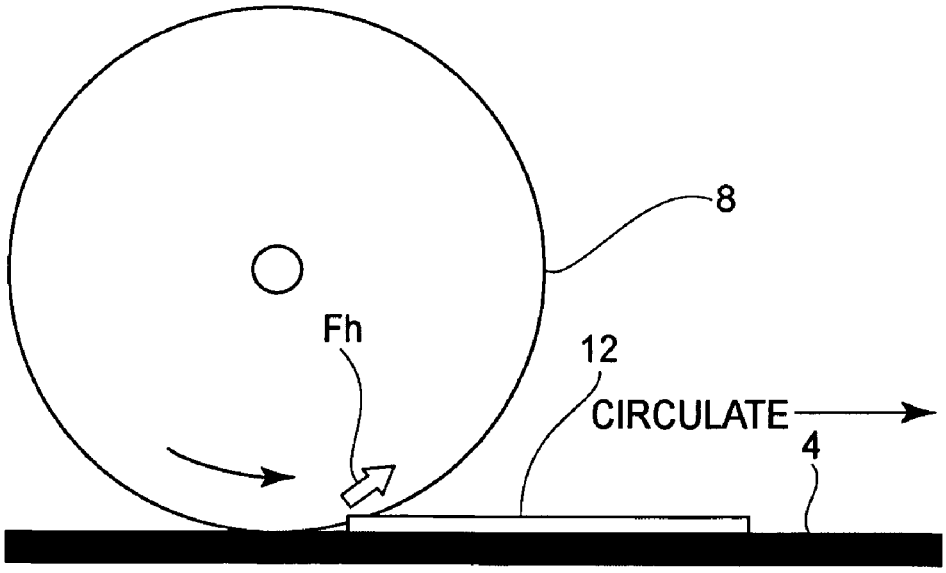
FIG. 11 is a schematic drawing showing the direction and manner in which the HP mark comes out of the area of contact between the primary transfer roller 8 and intermediary transfer belt 4.

FIG. 8 is a schematic plan view of the top and bottom layers of the double layer HP mark. FIGS. 9(*a*) and 9(*b*) are schematic drawings showing the structure of the double layer HP mark. FIG. 10 is a schematic cross section of the combination of the primary transfer roller 8, HP mark 12, and intermediary transfer belt 4, when the HP mark 12 is about to enter the area of contact between the roller 8 and intermediary transfer belt 4. FIG. 11 is a schematic cross section of the combination of the primary transfer roller 8, HP mark 12, and intermediary transfer belt 4, immediately after the HP mark 12 came out of the area of contact between the roller 8 and intermediary transfer belt 4.

Referring to FIG. 8, in the first embodiment, the HP mark 12 is made up of two HP marks 12*b* (top layer) and 12*a* (bottom layer).

The HP mark 12*b* (top layer) is the same in optical properties as the HP mark 12*a* (bottom layer). The HP mark 12*b* (top layer) is removably adhered to the HP mark 12*a* securely enough to withstand the circular movement of the intermediary transfer belt 4.

More concretely, the HP mark 12*a* (bottom layer) is pasted to the intermediary transfer belt 4, whereas the HP mark 12*b* (top layer) is adhered to the HP mark 12*a* (bottom layer). The fastness of the adhesion between the HP mark 12*b* (top layer) and HP mark 12*a* (bottom layer) is less than that between the HP mark 12*a* (bottom layer) and intermediary transfer belt 4, at least when the HP mark 12*b* (top layer) is peeled.

The HP mark 12 may be made up of three or more layered HP marks. In a case where the HP mark 12 is made up of three or more layered HP marks, it is desired that the closer a given HP mark to the bottommost HP mark (12*a*), the greater its adhesion to the next HP mark on the intermediary transfer belt 4 side, at least when it is removed, so that the topmost HP mark (topmost layer of HP mark 12, that is, damaged or worn HP mark) can be peeled away without affecting the next HP mark on the intermediary transfer belt 4 side.

The "lamination height" of the front edge portion (in terms of circulatory direction of intermediary transfer belt 4) of the HP mark 12*b* (top layer), that is, the distance between the top surface of the front edge portion of the HP mark 12*b* (top layer) and the outward surface of the intermediary transfer belt 4, is greater than the "lamination height" of the rear edge portion of the HP mark 12*b* (top layer), that is, the distance between the top surface of the rear edge (in terms of circulatory direction of intermediary transfer belt 4) of the HP mark 12*b* (top layer) and the outward surface of the intermediary transfer belt 4. Regarding the "lamination height" of the HP mark 12*b* (top layer), in a case where there is only one HP mark 12*a* (bottom layer) on the intermediary transfer belt 4, the "lamination height" of the rear edge portion of the HP mark 12 is the same as the thickness of the HP mark 12*a* or the transparent protective layer 12*b* itself.

As will be described in detail when the second embodiment is described, the HP mark 12*b* (top layer) may be replaced with a transparent protective sheet 12*b* so that the HP mark 12*a* (bottom layer) can be detected through the protective sheet 12*b*. In either case, peeling the top layer (HP mark 12*b* or protective sheet 12*b*) removes the stains and/or foreign matter, and therefore, restores in surface properties the HP mark 12 which is detected by the HP sensor 5.

Referring to FIG. 9(*a*), the intermediary transfer belt 4 is provided with the HP mark 12*a* (bottom layer) adhered to the intermediary transfer belt 4, and the HP mark 12*b* (top layer) adhered to both the HP mark 12*a* (bottom layer) and intermediary transfer belt 4.

Referring to FIG. 9(*b*), the intermediary transfer belt 4 is provided with the HP mark 12*a* (bottom layer) adhered to the intermediary transfer belt 4, and the HP mark 12*b* (top layer) adhered to both the HP mark 12*a* (bottom layer) and intermediary transfer belt 4, as described above. Thus, as the HP mark 12*b* (top layer) becomes significantly soiled or damaged, the HP mark 12*b* (top layer) can be peeled away to use the HP mark 12*a* (bottom layer) instead of the HP mark 12*b* (top layer). In other words, by exposing the HP mark 12*a* (bottom layer), that is, the HP mark which has not been soiled, it is possible to restore the surface properties of the inward surface of the intermediary transfer belt 4, to the normalcy, in terms of the amount (56 in FIG. 3) by which light is reflected by the inward surface (inclusive of HP mark 12) of the intermediary transfer belt 4, represented by the line C1 in FIG. 7.

The HP marks 12*a* and 12*b* are on the inward side of the intermediary transfer belt 4. Therefore, they repeatedly come into contact with, and separate from, the driver roller 6, inward secondary transfer roller 7, tension roller 9, and primary transfer roller 8, which are shown in FIG. 1.

Referring to FIG. 10, the moment the HP mark 12 enters the area of contact between the intermediary transfer belt 4 and one of these rollers (primary transfer roller 8, for example), the front edge of the HP mark 12 is subjected to a force Fm, which acts in the direction to press the HP mark 12 upon the intermediary transfer belt 4.

On the other hand, the moment the HP mark 12 comes out of the area of contact between the intermediary transfer belt 4 and one of these rollers (primary transfer roller 8, for example), the rear edge of the HP mark 12 is subjected to a force Fh which acts in the direction to peel the HP mark 12 away from the intermediary transfer belt 4, as shown in FIG. 11. In this embodiment, therefore, in order to reduce the distance which the primary transfer roller 8, for example, descends the moment the HP mark 12 comes out of the area of contact between the HP mark 12 and intermediary transfer belt 4, that is, the height of the step between the rear edge of the top surface of the HP mark 12 and the inward surface of the intermediary transfer belt 4, the HP mark 12*b* (top layer) is made longer than the HP mark 12*a* (bottom layer), and pasted to both the HP mark 12*a* (bottom layer) and intermediary transfer belt 4, in such a manner that the rear end portion of the HP mark 12*b* (top layer) extends rearward (in terms of moving direction of intermediary transfer belt 4) beyond the rear edge of the HP mark 12*a* (bottom layer), as shown in FIG. 9(*b*).

From the standpoint of ensuring that the HP marks 12*a* and 12*b* are satisfactorily durable, the selection of the material for the HP marks 12*a* and 12*b*, and the procedure for testing the HP marks 12*a* and 12*b*, must be taken into consideration. In particular, it is desired that the substances which are superior in wear resistance, shock resistance, tensile strength, and adhesiveness, are chosen as the materials for the HP marks 12*a* and 12*b*, along with the HP mark pasting methods which are superior in wear resistance, shock resistance, tensile strength, and adhesion.

The HP mark 12*a* (bottom layer), that is, the HP mark which is to be adhered in its entirety to the intermediary transfer belt 4, must be pasted to the intermediary transfer belt 4 securely enough to be prevented from peeling with the HP mark 12*b* (top layer) when the HP mark 12*b* (top layer) is peeled.

On the other hand, not only must the HP mark 12*b* (top layer) be satisfactory in terms of the above-mentioned durability, but also, be not too fast in terms of adhesion to the intermediary transfer belt 4 and HP mark 12*a* (bottom layer), while being fast enough to remain adhered to the intermediary transfer belt 4 and HP mark 12*a* (bottom layer) until it needs to be peeled, for the following reasons. That is, in order to peel the HP mark 12*b* (top layer), a service person has to stick his finger into the tiny space in the apparatus main assembly 100A (FIG. 1), making it difficult to yield a large amount of force through the fingertip. Further, if the HP mark 12*b* (top layer) is too fast in terms of adhesion, it is possible that the mechanisms in the adjacencies of the intermediary transfer belt 4 will be subjected to a substantial amount of force, and/or the intermediary transfer belt 4 will be creased or scratched, when the HP mark 12*b* (top layer) is peeled. This is why the HP mark 12*b* (top layer) should be small enough in adhesive strength to be easily peelable when it needs to be peeled, but, is large enough in adhesive strength to remain adhered to the HP mark 12*a* and intermediary transfer belt 4 in the normal operation.

Further, it is necessary that the HP mark 12*b* (top layer) does not leave a significant amount of trace (residue) after it is peeled, and also, that the adhesive for the HP mark 12*b* (top layer) does not ooze out, and also, does not allow the HP mark 12*b* (top layer) to displace, even if there is a significant increase in temperature and/or friction. Moreover, the HP mark 12*b* (top layer) is required to be fast enough in its adhesion to the HP mark 12*a* (bottom layer) and intermediary transfer belt 4 not to be displaced by the friction which occurs between the HP mark 12*b* and the above-mentioned rollers as the intermediary transfer belt 4 is circularly moved while being supported by the rollers. The above-described properties which the HP marks 12*a* and 12*b* are required to have are summarized in Table 1.

TABLE 1

| | Easiness | Pulling | Fastness |
|---|---|---|---|
| Top L. mark | easy | hard | strong |
| Btm. L. mark | hard | hard | strong |

It is desirable that both the material for the HP mark 12*b* (top layer) and the material for the HP mark 12*a* (bottom layer) satisfy the properties in Table 1 required of them. The HP mark 12*a* (bottom layer) does not need to be peeled. Therefore, a substance higher in durability may be selected as the material for the HP mark 12*a* (bottom layer), and an adhesive greater in fastness may be chosen as the adhesive for the HP mark 12*a* (bottom layer). On the other hand, the HP mark 12*b* (top layer) is desired to be formed of a durable substance. However, the adhesive for the HP mark 12*b* (top layer) is desired to be fast enough to prevent the HP mark 12*b* (top layer) from displacing, while being not too fast to prevent the HP mark 12*b* (top layer) from being easily peeled.

<Description of Various Measuring Methods>

Figure 12:
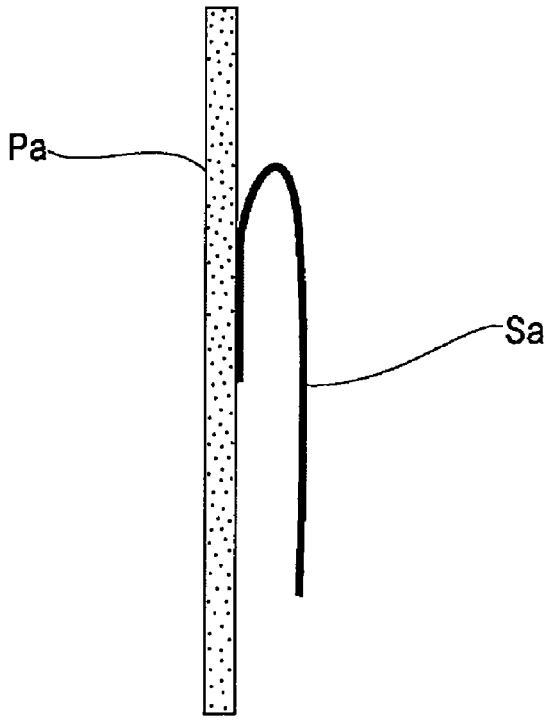
FIG. 12 is a schematic drawing of a stainless steel plate Pa and an adhesive sheet Sa, showing the method for testing the adhesive strength of the adhesive sheet Sa, and the level of ease with which the adhesive sheet Sa can be peeled.
Figure 13:
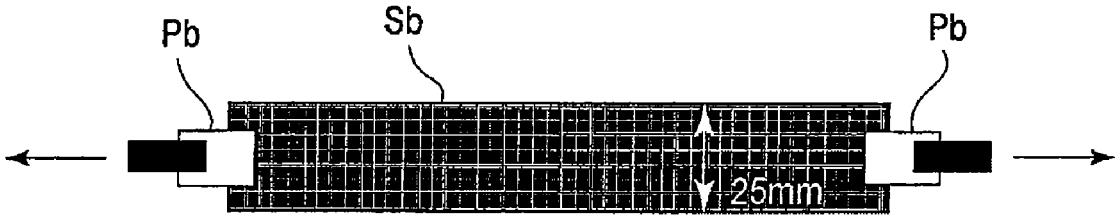
FIG. 13 is a schematic drawing of a pair of clamps Pb and an adhesive sheet Sb, showing the method for testing the tensile strength of the adhesive sheet Sb.
Figure 14:
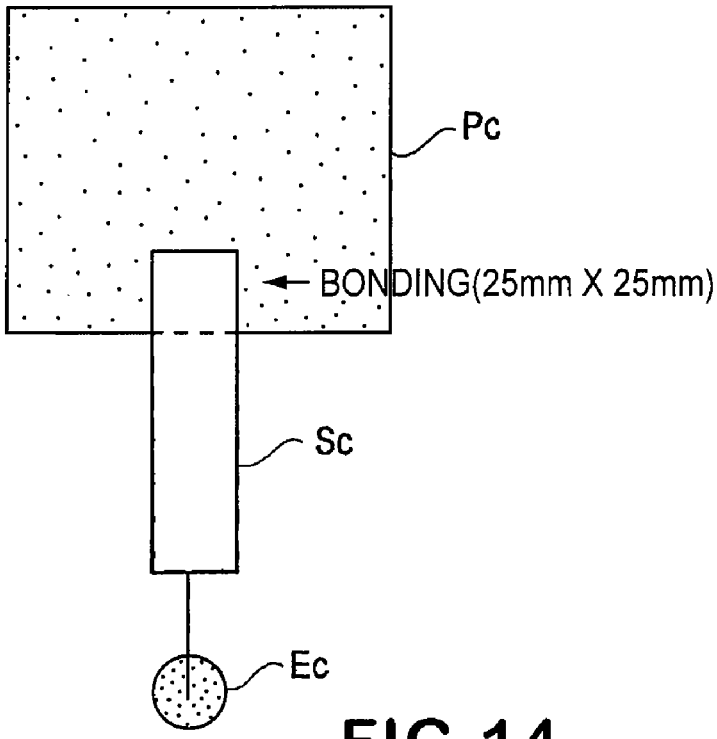
FIG. 14 is a schematic drawing of a stainless steel plate Pc and an adhesive sheet Sc, showing the method for testing the adhesive sheet Sc in terms of the fastness of adhesion.

FIG. 12 is a schematic sectional view of the combination of the stainless steel plate Pa and an adhesive sheet Sa, describing the method for testing the HP marks 12*a* and 12*b* in terms of the level of the fastness of its adhesion and the level of ease with which they can be peeled. FIG. 13 is a schematic drawing showing the method for testing of the tensile strength of the adhesive sheet Sa. FIG. 14 is a schematic drawing showing the method for testing the adhesive sheet Sc in terms of fastness of adhesion. The index for the ease with which adhesive tape or sheet can be peeled, index for the tensile strength of adhesive tape or sheet, index for the adhesiveness of the adhesive tape or sheet, and the like, and the methods for testing the above-mentioned properties of the adhesive tape or sheet, are defined in detail in JIS (Japanese Industrial Standards) Z-0237. The following descriptions of these subjects are in accordance with JIS Z0237. The adhesive sheet, which was used as the material for the HP marks 12*a* and 12*b* in this embodiment, was selected in accordance with the above-mentioned standards.

Referring to FIG. 12, the level of ease with which adhesive sheet can be peeled was measured by using the "180 degree peel test", in which a piece of adhesive sheet, which is 25 mm in width, is pulled in the direction parallel to the surface to which it has been adhered, with the point of separation being on the opposite end from the direction from which the adhesive sheet is pulled. More specifically, various adhesive sheets Sa were adhered to a stainless steel plate Pa by shuttling once a rubber roller, which is 2 kg in weight and 45 mm in width, across the adhesive tape placed on the stainless steel plate Pa. Then, the adhesive sheets were measured in terms of the level of ease with which they can be peeled, 20 minutes after they are adhered. The surface of the stainless steel (SUS304) plate Pa, to which the adhesive sheets were to be adhered, had been roughened by rubbing its surface with No. 280 polishing paper. The peeling speed was 300 mm/min. The amount of force Fr which was necessary to peel the adhesive sheet was measured in unit N. Thus, the level of ease with which the adhesive sheet was peeled is expressed in the amount of force Fr (N/25 mm), which was necessary to peel the adhesive sheet. Then, the level of ease with which the adhesive sheet could be peeled was expressed in unit of N/cm, that is, unit (value) obtained by multiplying Fr by four.

Referring to FIG. 13, the tensile strength of the adhesive tape was measured by clumping the two ends of each of 25 mm wide adhesive sheets with a pair of clamps Pb, one for one, and pulling the adhesive tape in the opposite directions, to measure, in a unit of N, the amount of force Ft necessary to tear the adhesive tape. Thus, the tensile strength of each adhesive sheet was expressed in a unit of Ft (N/cm).

Referring to FIG. 14, the fastness of the adhesive sheet was evaluated using a fastness test which measured the amount by which the adhesive sheet is displaced as a preset amount of load is applied to thereto. More specifically, the adhesive sheet Sc was pasted to a stainless steel plate Pc by shuttling a roller, which is 2 kg in weight, once on the adhesive tape Sc across the entire length of the adhesive tape Sc. Then, the test was started 20 minutes after the pasting of the adhesive tape Sc. In the test, a load Ec (1 kg) was continuously applied to the adhesive sheet Sc, and the distance the adhesive sheet Sc was displaced by the load Ec in 15 minutes was measured in millimeters. The smaller the distance, the greater the adhesive sheet in the fastness of its adhesion.

Incidentally, as the method for measuring the level of ease with which the adhesive sheet can be peeled, the "180° peel force measuring method" was used. However, JIS Z 0237 provides the definitions of other methods for testing the fastness (peel force) of the adhesive sheet, for example, the 90° method, 45° method, etc. Thus, the material for the adhesive tape may be selected based on the data obtained using a 90° peel force test.

<Material for HP Mark>

The results of the evaluation of the adhesive sheets of various makers as the materials for the HP marks 12*a* and 12 are given in Table 2.

TABLE 2

| Base Mat. | Treat | Thick | Ad. Mat. | Layer | Elongat'n (%) | Strgth | Value | Peeling |
|---|---|---|---|---|---|---|---|---|
| 1 Epoxy film | Y | 0.15 | Heat-curing rubber | | 100 | 5 | 5.5 | G |
| 2 Polyester | Y | 0.06 | Acrylic | 0.035 | 100 | 3.3 | 4.5 | G |
| 3 Polyester | Y | 0.08 | Acrylic | 0.03 | 110 | 3.3 | 4.7 | G |
| 4 Polyester | Y | 0.06 | Heat-curing rubber | 0.035 | 100 | 5.5 | 6.6 | G |
| 5 Polyester | N | 0.08 | Rubber | 0.03 | 130 | 3.6 | 3.3 | G |
| 6 Polyester | N | 0.08 | Acrylic | 0.03 | 130 | 3.9 | 3.7 | G |
| 7 U-high molecular w. polyethylene | N | 0.18 | Rubber | 0.05 | 400 | 2.6 | 4.4 | G |
| 8 Polyvinyl fluoride | Y | 0.09 | Acrylic | 0.04 | 180 | 5.1 | 5.4 | G |
| 9 Polyester | Y | 0.11 | Rubber | 0.072 | 120 | 19.6 | 12.5 | NG |
| 10 U-high molecular w. polyethylene | N | 0.16 | Acrylic plus Adhering | 0.03 | 300 | 5.5 | 4.3 | G |
| 11 U-high molecular w. polyethylene | N | 0.28 | Acrylic | 0.15 | 300 | 8.6 | 7.0 | F |

Peeling property
G: good:
F: fair
NG: not good

In Table 2, Materials 1, 2, 3, and 4 are products of Sumitomo 3M Ltd., the registered trade names of which are Super 10, 1350F (white) 0.06 mm, 1350F (white) 0.08 mm, and 56, respectively.

Materials 5, 6, and 11 are products of Nitto Denko Corp., the registered trade names of which are No. 31B, 4430, and 443, respectively.

Materials 7 and 8, and 9 are also products of Sumitomo 3M Ltd., the registered trade names of which are 5421, 838, and 859, respectively.

Also in Table 2, the unit of measurement for the thickness of the substrate of the adhesive sheet, and the thickness of the adhesive layer of the adhesive sheet, is millimeter. The values of the adhesive strength are the values obtained by measuring the adhesive strength of the adhesive sheet relative to the stainless steel plate Pc, in accordance with JIS. These values were provided as specifications by the makers. In comparison, the column of actually measured adhesive strength shows the values obtained through the tests conducted by the inventors of the present invention to measure the adhesive strength of these adhesive sheets relative to a polyimide (PI) plate, using the same method as those used by the makers, in anticipation of the pasting of the adhesive sheets to the intermediary transfer belt 4. The column of separation (peeling) shows the state of the polyimide plate surface (surface of intermediary transfer belt 4) in terms of the appearance and amount of the adhesive remaining on the polyimide plate after the peeling of the adhesive tape.

Table 3 shows the results of the measurement of the adhesive strength of Materials 1-8, shown in Table 2, pasted to Materials 4, 5, 9, and 11 pasted to the polyimide plate surface.

TABLE 3

| | above 4 | | | above 5 | | | above 9 | | | above 11 | | |
|---|---|---|---|---|---|---|---|---|---|---|---|---|
| Mat. # | *1 | *2 | *3 | *1 | *2 | *3 | *1 | *2 | *3 | *1 | *2 | *3 |
| 1 | 5 | G | G | 10 | G | G | 0.04 | N | G | 5.2 | G | G |
| 2 | 2.2 | N | G | 6.6 | G | G | 0.06 | N | G | 2 | N | G |
| 3 | 0.8 | N | G | 5.6 | G | G | 0.07 | N | G | 1.4 | N | G |
| 4 | 0.6 | N | G | 8 | G | G | 0.06 | N | G | 5.2 | G | G |
| 5 | 1.6 | N | G | 4.8 | G | G | 0.04 | N | G | 1.4 | N | G |
| 6 | 1.4 | N | G | 3 | N | G | 0.02 | N | G | 0.8 | N | G |
| 7 | 2.6 | N | G | 3.5 | N | G | 0.05 | N | G | 1.8 | N | G |
| 8 | 3 | N | G | 7.8 | G | G | 0.23 | N | G | 4 | G | G |

*1: adhesion strength
*2: durability
*3: peeling property
G: good
N: not good

In Table 3, the numbers in the adhesive strength column are the values of the actually measured adhesive strength (N/cm) of the materials; the referential symbols in the durability column represent the evaluation of the materials in terms of durability; and the referential symbols in the separability column represent the evaluation of the materials in terms of separability. The durability of the materials was tested by continuously driving the intermediary transfer belt 4 for a preset length of time (substantial length of time) under a high temperature-high humidity condition. A symbol "G" means that a given material satisfactorily held, and a symbol "NG" means that a given material did not satisfactorily withstand the test. The separability of the materials was tested by actually peeling them. A symbol "G" means that the peeling of a given material did not cause the intermediary transfer belt (4 in FIG. 1) to permanently deform, and a symbol "NG" means that the peeling of a given material caused the intermediary transfer belt to permanently deform.

Among the various combinations between the intermediary transfer belt 4 and a given material for the adhesive sheet, those in which adhesive strength was no more than 4.0 N/cm may not be satisfactory in terms of durability for the following reason. That is, if an image forming apparatus is operated for a substantial length of time under the high temperature-high humidity condition, the materials for the HP marks reduce in adhesive strength, becoming likely to easily peel. In other words, the materials which are no more than 4.0 N/cm in adhesive strength are not suitable as the material for HP marks. On the other hand, if a given material is no less than 10.0 N/cm in adhesive strength, it may pull the intermediary transfer belt 4 hard enough to make the intermediary transfer belt 4 wavy, when it is peeled; it is highly possible that it may permanently deform the intermediary transfer belt 4.

In this embodiment, based on the results shown in Tables 2 and 3, Material 4, the substrate of which is formed of polyester, and the adhesive layer of which is formed of a thermally curable rubber-based adhesive, was selected as the material for the HP sheet 12*a* (bottom layer). As the material for the HP mark 12*b* (top layer), Material 1, the substrate of which is epoxy film, and the adhesive of which is thermally curable rubber-base adhesive, was selected. Generally, rubber-base adhesive is less in adhesive strength than acrylic-base adhesive. Therefore, it is determined that rubber-based adhesive is better as the adhesive for the material for the HP mark 12*b* (top layer).

As for the color of adhesive sheet, from the standpoint of the reflectivity, which is required of the HP marks, the desirable color for the adhesive sheet is white for both the HP marks 12*a* and 12*b*. However, bright color, such as yellow, is acceptable, as long as yellow adhesive can provide a sufficient amount of contrast in reflectivity between the intermediary transfer belt 4 and HP marks 12*a* and 12*b*.

In terms of the fastness of adhesion, the adhesive sheets as the materials for the HP marks 12*a* and 12*b* are desired to be in a range of 0-1 mm. In consideration of the durability of the HP marks 12*a* and 12*b*, the adhesive sheet as the material for the HP marks 12*a* and 12*b* need to be very fast in their adhesion to the intermediary transfer belt 4.

In terms of adhesive strength (amount of force necessary to peel), it is necessary that adhesive sheet which is weaker than the adhesive sheet selected as the material for the HP mark 12*a* (bottom layer) is selected as the material for the HP mark 12*b* (top layer), for the following reason. That is, if the HP mark 12*b* (top layer) and HP mark 12*a* (bottom layer) are close in adhesive strength, or the former is stronger than the latter, it is possible that as the HP mark 12*b* (top layer) is peeled, the HP mark 12*a* (bottom layer) peels with the HP mark 12*b* (top layer).

Incidentally, the values of the adhesive strength of various adhesive sheets given in Table 2 were obtained by testing the various adhesive sheets, in accordance with JIS Z 0237, using the stainless steel plate Pa. Thus, the inventors of the present invention measured the adhesive strength of the adhesive sheet as the material for the HP mark 12*b* (top layer), relative to polyfluorovinyl sheet, which is the material for the substrate of the HP mark 12*a* (bottom layer), and also, the fastness of their adhesion to the polyfluorovinyl sheet. They also measured the adhesive strength of the adhesive sheet as the material for the HP mark 12*a* (bottom layer), relative to the polyimide (PI), which is the material for the intermediary transfer belt 4, and also, the fastness of adhesion of the adhesive sheet to the polyimide (PL) sheet.

The results of the measurements proved that the relationship in terms of adhesive strength between the HP marks 12*b* (top layer) and 12*a* (bottom layer) satisfied the required relationship: adhesive strength of HP mark 12*b* (top layer)<adhesive strength of HP mark 12*a* (bottom layer). As will be evident from Table 2, the adhesive strength of the HP mark 12*a* (bottom layer) in this embodiment was 6.6. Further, as will be evident from Table 3, the adhesive strength of the HP mark 12*b* (top layer) in this embodiment was 5. In terms of fastness, the HP mark 12*b* (top layer) was 0.5 mm, whereas the HP mark 12*a* (bottom layer) was 1 mm.

It is desired that the HP marks 12*a* and 12*b* are provided with a certain amount of elasticity. The intermediary transfer belt 4 is caused to repeatedly stretch and shrink. By being capable of stretching or shrinking along with the intermediary transfer belt 4, not only can the HP marks 12*a* and 12*b* reduce the amount of load to which their adhesives are subjected, but also, they are not made to wrinkle. As long as the HP marks 12*a* and 12*b* are capable of reversibly stretching by ±30% (upper limit corresponds to value beyond which HP marks 12*a* and 12*b* tear), there will be no problem, although these figures are affected by other factors such as the diameter of the rollers by which the intermediary transfer belt 4 is supported.

<Procedure for Restoring HP Mark>

Figure 22:
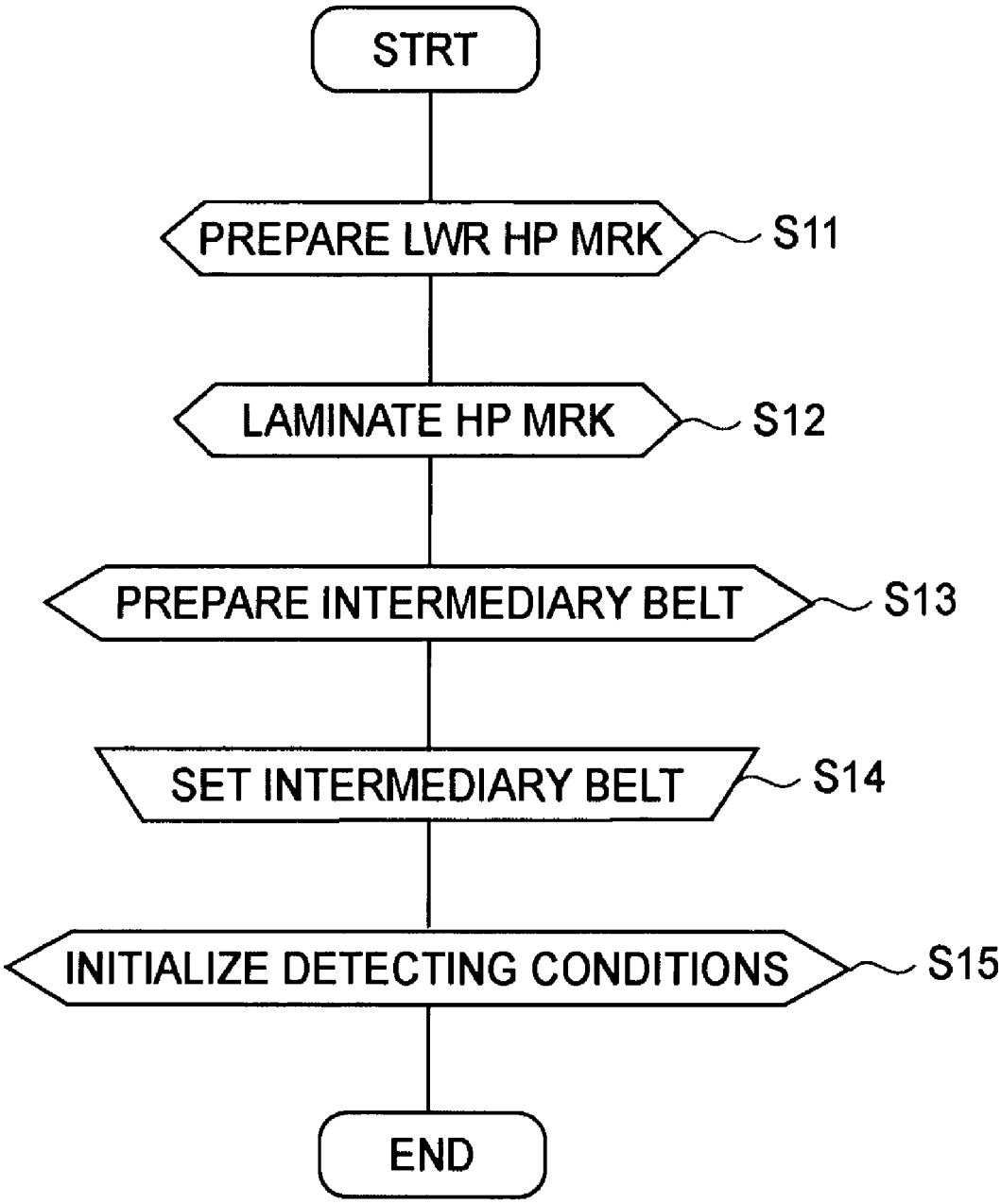
FIG. 22 is a flowchart of the intermediary transfer belt assembly process.
Figure 23:
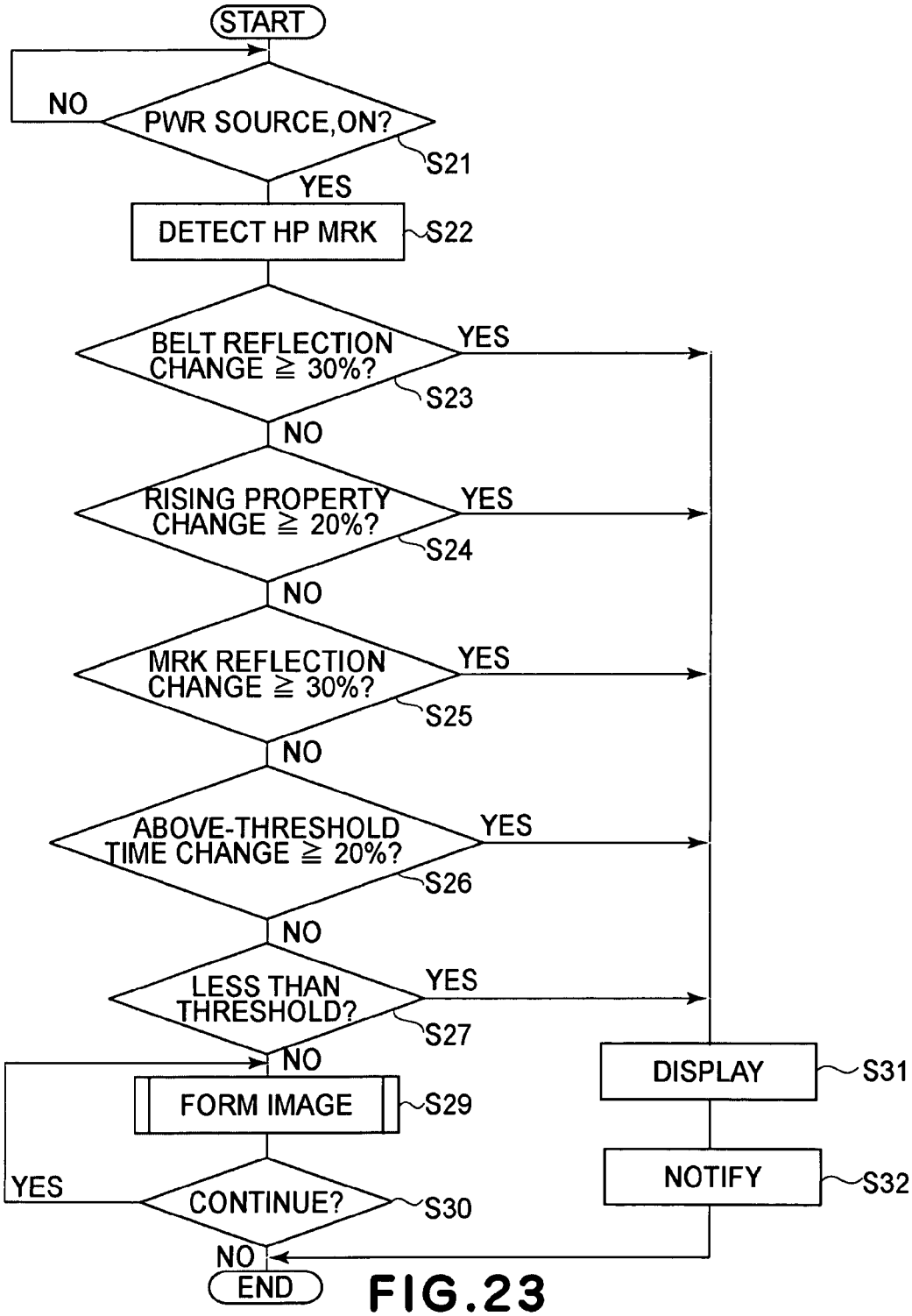
FIG. 23 is a flowchart of the sequence for evaluating the degree of wear of the HP mark.
Figure 24:
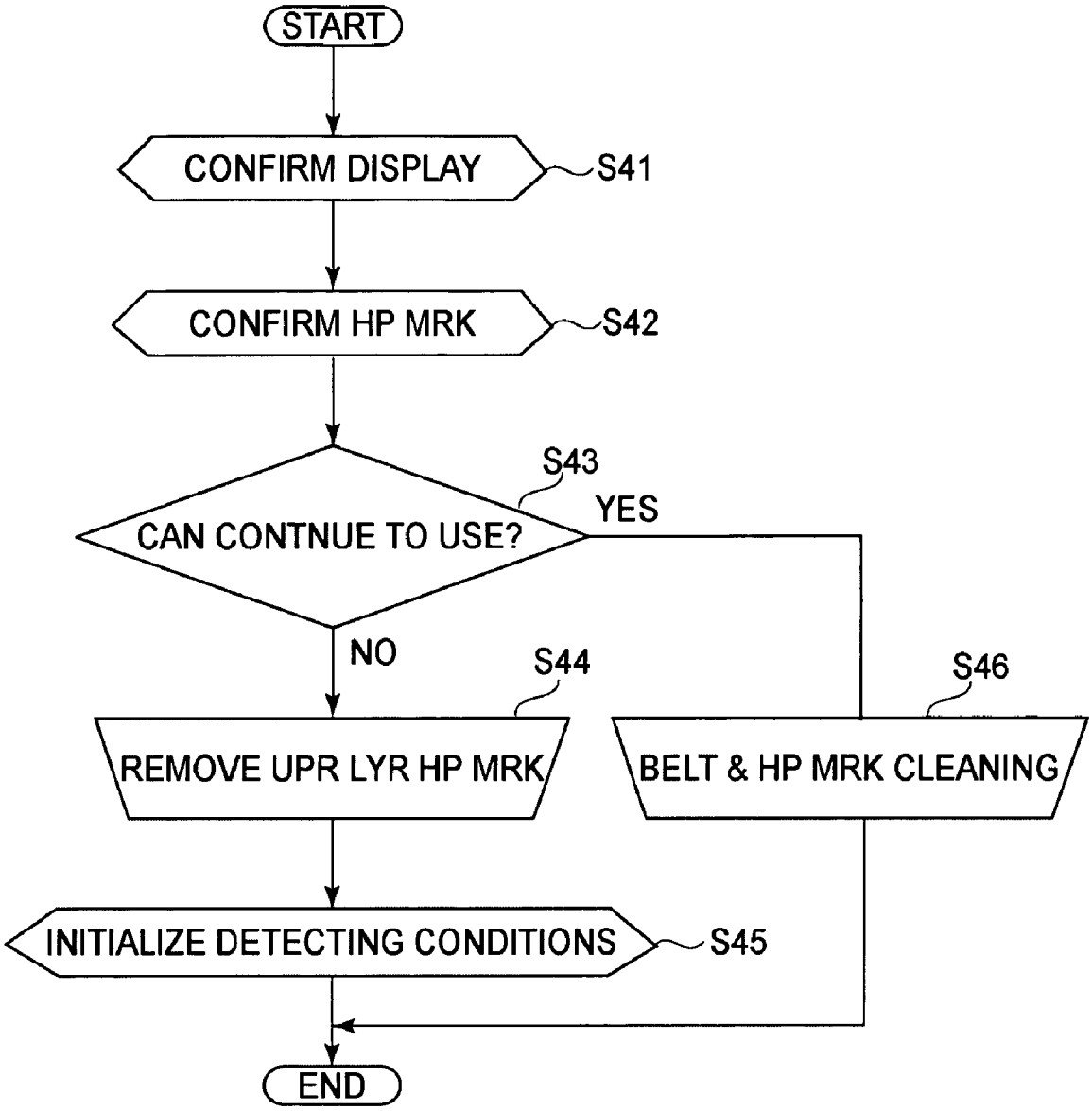
FIG. 24 a flowchart of the sequence for restoring the HP mark if it is detected that the HP mark has become difficult to accurately detect.
Figure 25:
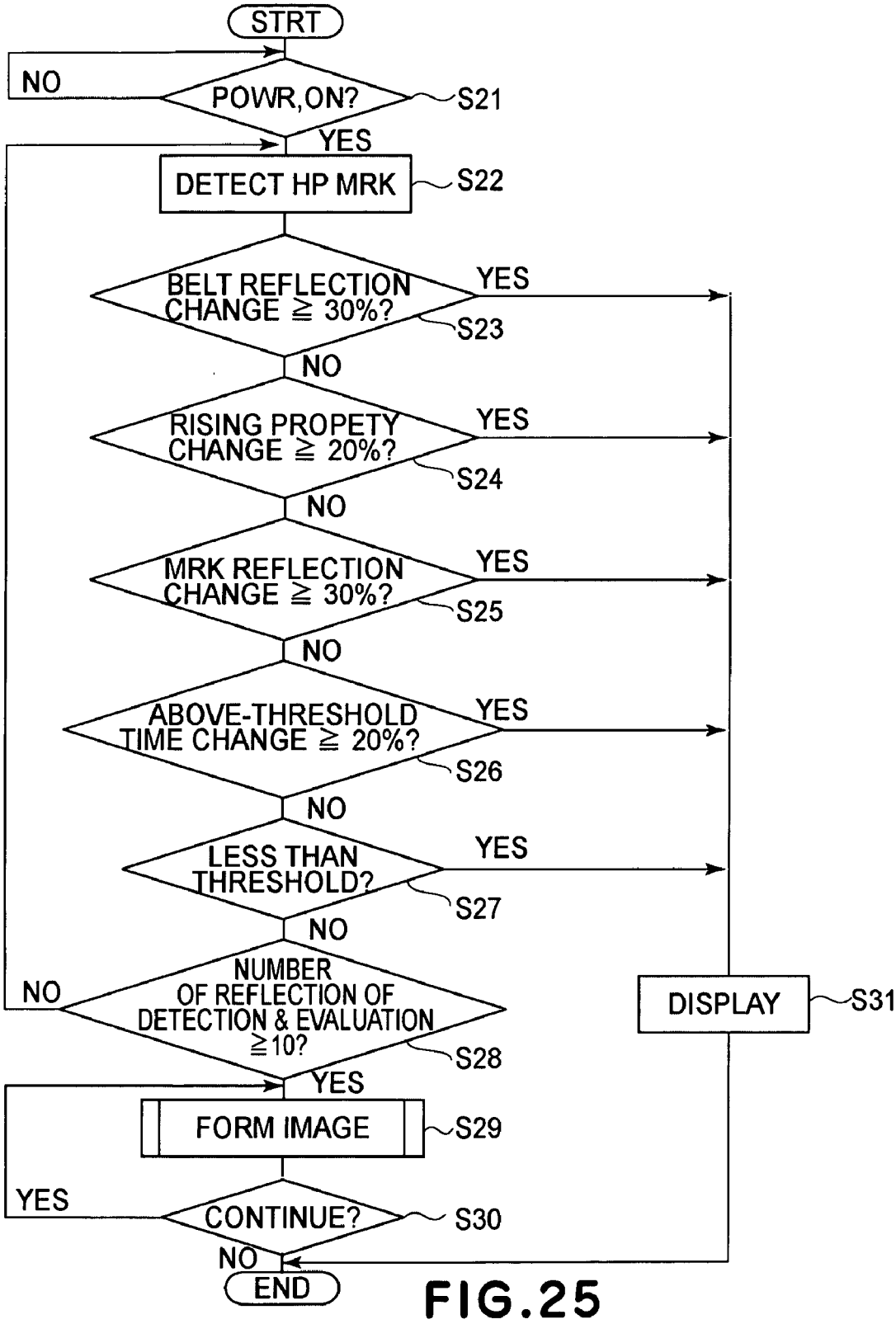
FIG. 25 is a flowchart of the sequence for restoring the HP mark control system.

FIG. 22 is a flowchart of the intermediary transfer belt assembly sequence, and FIG. 23 is a flowchart of the sequence for evaluating the HP marks in terms of wear. FIG. 24 is a flow chart of the process for restoring the HP mark, which is to be carried out as the HP mark fails to be satisfactorily detected. FIG. 25 is a flowchart of the process which is to be carried out by a user to restore the HP mark.

Incidentally, although described below is the procedure for restoring the HP mark in this embodiment, the procedures for restoring the HP mark in the second to fifth embodiments are similar to that for restoring the HP mark in this embodiment. Therefore the procedures for restoring the HP marks in the second to fifth embodiment will not be described to avoid repeating the same description.

Referring to FIGS. 1 and 9(*b*), the control portion 110 evaluates the degree of the optical damage of the HP mark 12*b* (top layer) (or transparent protective sheet), based on the output of the HP sensor 5, in order to determine when to remove the HP mark 12*b* (top layer). Then, the control portion 110 displays (or communicates with use of some means) the point in time for the removal of the HP mark 12*b* (top layer) (or transparent protective sheet). Then, as soon as the information that the removal of the HP mark 12*b* (top layer) (or transparent protective sheet) is completed, is inputted, the control portion 110 resets the HP sensor 5 in terms of the criteria used for determining whether or not the HP mark 12*a* (bottom layer) is at the HP sensor 5.

Figure 15:
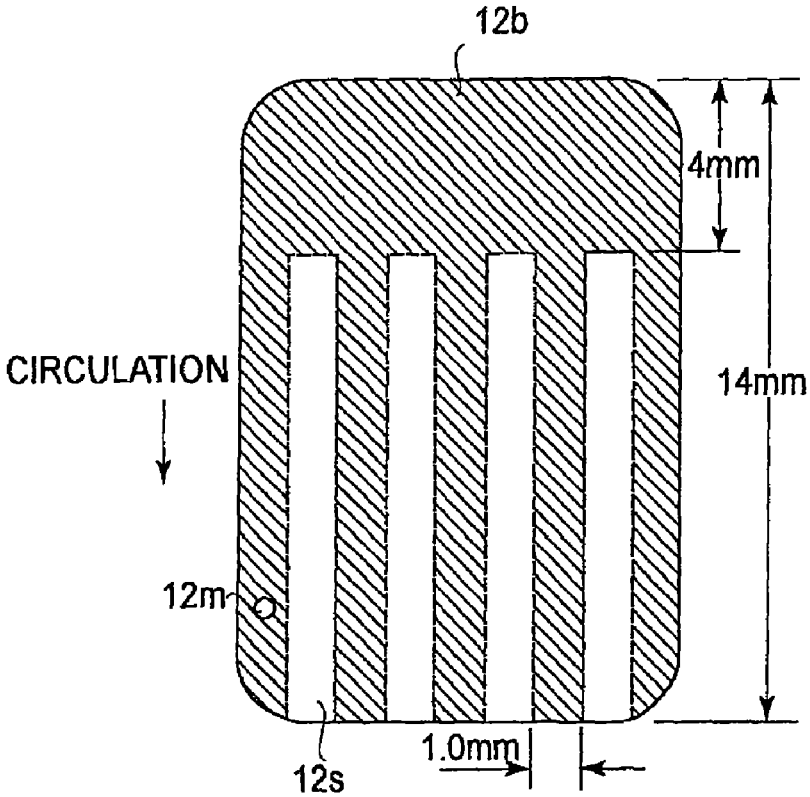
FIG. 15 is a schematic plan view of the HP mark 12*b*, that is, the top layer of the first of the modified versions of the HP mark in the first embodiment.

Next, referring to FIGS. 9 and 22, first, a HP mark 12*a* (bottom layer) coated in advance with the adhesive is prepared (S11). Then, the HP mark 12*b* (top layer) is pasted on the substrate of the HP mark 12*a* (bottom layer), and a separation paper called a separation liner is pasted to the HP mark 12*a* (bottom layer), and the combination is pressed (S12). The separation liner is a laminae made up of a piece of high quality paper, and a piece of polyethylene sheet adhered to the high quality paper. It has been given a silicone treatment which made the separation liner easier to separate from an object with which it is in contact. Referring to FIG. 15, the HP mark 12*b* (top layer) is coated with adhesive, while remaining partially masked with a few strips of masking tape. Then, the masking tape is peeled, exposing the areas 12*s* which have not been coated with the adhesive.

Then, the laminae made up of the layer which will turn into the HP mark 12*a* (bottom layer) and the layer which will turn into the HP mark 12*b* (top layer) is cut into multiple HP marks of a preset size (10 mm (vertical dimension)×14 mm (horizontal dimension)), or is provided with multiple perforated lines for facilitating the separation of each HP mark from the rest. Then, one of the HP marks formed through the above-described process is pasted on the preset location of the inward surface of the intermediary transfer belt 4 after removing the separation liner therefrom (S13). This is the final step of the process for manufacturing the intermediary transfer belt 4.

The intermediary transfer belt 4 prepared through the above-described process is mounted into the precursor of the apparatus main assembly 100A of the image forming apparatus 100 shown in FIG. 1 (S14). Then, the operation for initializing the HP sensor 5 in terms of the criteria used for determining whether or not the HP mark is at the HP sensor 5, is carried out (S15).

More specifically, referring to FIGS. 5 and 6, the HP sensor 5 detects the arrival of the HP mark 12 by comparing the amount 56 of the reflected light, which is received by the light receiving portion 51, with the threshold value A. Then, if the length of time the amount 56 of the reflected light exceeds the threshold value A is longer than a preset value, the control portion 110 determines that the HP mark 12 has arrived at the HP sensor 5. If the threshold value A is rigidly set, the process carried out by the control portion 110 is likely to be easily affected by the variation (tolerance) in properties among the HP sensors, variation in the distance between the intermediary transfer belt 4 and HP sensor 5, variation in color of the intermediary transfer belt 4, variation in color of the HP mark 12, and/or the like factors. Thus, in order to compensate for these variations, the HP sensor 5 needs to be initialized in terms of the above-mentioned HP mark detection criteria, each time the intermediary transfer belt 4 is replaced or modified.

Referring to FIG. 1, when the image forming apparatus 100 is set up, or right after the intermediary transfer belt 4 is replaced, the control portion 110 rotates the intermediary transfer belt 4 and starts the operation to detect the arrival of the HP mark at the HP sensor 5.

Referring to FIG. 5, the CPU 121 (main control) sends to an LED control portion 53 a command which makes the LED control portion 53 control the amount by which the beam of light is emitted, based on the amount of the light detected by the HP sensor 5. In the first embodiment, the light emitting portion 52 is controlled in the amount by which it emits light, so that the output value of the light receiving portion 51 (PD) becomes 3 V. After the HP sensor 5 is adjusted in the amount by which its light emitting portion 52 emits light, it informs the CPU 121 (main control) of the total amount of reflected light received by the light receiving portion 51 while the intermediary transfer belt 4 makes one full rotation. Further, the CPU 121 stores the amount of the offset voltage, that is, the voltage outputted by the light receiving portion 51 while the light emitting portion 52 is off. The threshold value A shown in FIG. 6 is equal to 40% of the average value of the amount 56 of the light reflected by the HP mark 12.

Through the above-described operation, the CPU 121 (main control) obtains the initial characteristics of the HP mark, which is necessary to initialize the criteria for determining whether or not the HP mark is at the HP sensor 5, and stores the obtained initial characteristics of the HP mark. The examples of the initial characteristics of the HP mark are: the startup characteristic (length of time it takes for average amount of light reflected by intermediary transfer belt 4 to increase to average amount of light reflected by HP mark 12), average amount of light reflected by the HP mark 12, threshold value A, and point in time at which the amount 56 of the reflected light exceeds the threshold value A. The CPU 121 (main control) senses the amount 56 by which the light from the light emitting portion 52 is reflected by the inward surface of the intermediary transfer belt 4, and stores the average amount 56 by which the light from the light emitting portion 52 is reflected by the inward surface of the intermediary transfer belt 4, and also, the amount 56 of the light reflected by the inward surface of the intermediary transfer belt 4 when the light emitting portion 52 is off. This ends the initializing operation (S15).

Referring again to FIG. 1, as the cumulative number of copies outputted by the image forming apparatus 100 increases, the HP mark 12 becomes soiled: the coloring agents, various volatile substances, byproducts of electrical discharge, dust, debris, etc., in the apparatus main assembly 100A adhere to the HP mark 12. If the HP becomes soiled beyond a certain level, it becomes impossible for the multiple toner images, different in color, to be transferred in perfect alignment onto the recording medium P, or the error message indicating that an image forming operation cannot be carried out is outputted, as described previously. If this type of problem occurs, it is necessary for a service person or the like to peel the HP mark 12*b* (top layer), as shown in FIG. 9, so that the HP mark 12*a* (bottom layer) can be used for the subsequent image forming operations. The structure of the HP mark 12 (made up of HP marks 12*a* and 12*b*), and the method for peeling the HP mark 12*b* (top layer), are the same as those described when the first to fifth preferred embodiments of the present invention are described.

In the first embodiment, in anticipation of the imminent occurrence of the above-described problems, the CPU 121 (main control) prompts an operator (user) to peel the HP mark 12*b* (top layer) before the image forming apparatus 100 begins forming an unsatisfactory image, or makes an operational error. More specifically, the control portion 110 compares the results of the HP mark detection by the HP sensor 5, with those immediately after the HP sensor 5 was initialized in terms of the HP mark detection criteria. If it is detected that the image forming apparatus reduced by a certain amount in the accuracy with which the HP mark 12 is detected, the control portion 110 prompts a service person (or operator), through the display/control panel 108, shown in FIG. 2, and a service point terminal 109, that the HP mark 12 needs to be restored. The employment of this setup significantly reduces the frequency with which the image forming apparatus is unexpectedly stopped, compared to the setup that the error message is displayed only when the HP sensor 5 fails to generate the timing signal for starting to write an electrostatic image.

Referring to FIGS. 1 and 23, as the electric power source of the image forming apparatus 100 is turned on (Yes in S21), the control portion 110 idles the intermediary transfer belt 4 and detects the HP mark 12 (S22). As soon as it is detected that it is possible that the HP mark detection accuracy has declined; one or more of the following criteria are met, the control portion 110 proposes, through the display/control panel 108, that the HP mark 12 be cleaned or the HP mark 12*b* (top layer) be peeled (S31). Further, the control portion 110 connects the image forming apparatus 100 to the external communication network through the communication interface 113, shown in FIG. 2, and sends the same message to the service point terminal 109 (S32). Obviously, the communication interface 113 may be set up so that the control portion 110 directly reaches the portable telephone of a service person, as well as the service point terminal 109.

(1) If the amount 56 by which the light receiving portion 51 receives the light reflected by the inward surface of the intermediary transfer belt 4 changes by no less than 30% compared to that immediately after the initialization of the HP sensor 5 (Yes in S23), it is checked whether or not the inward surface of the intermediary transfer belt 4 has been excessively soiled or damaged. As for the direction in which changes occur to the amount by which light is reflected by the inward surface of the intermediary transfer belt 4, because of the soiling of the HP mark 12 and/or damage thereto, they are generally downward. In reality, however, the amount 56 increase as well as decrease.

(2) If the startup characteristic of the HP mark 12 increased by no less than 20% compared to the initial startup characteristic of the HP mark 12 (Yes in S24), how bad the soiling of the HP mark 12 and/or damage to the HP mark 12 is to be checked, and also, how bad the soiling of the inward surface of the intermediary transfer belt 4 and/or damage to the inward surface of the intermediary transfer belt 4 is to be checked. The startup characteristic means the length of time it takes for the amount of the light which the light receiving portion 51 receives increases from the average amount of light which the light receiving portion 51 receives when the inward surface of the intermediary transfer belt 4 (in true sense) is facing the HP sensor, to the average amount of light which the light receiving portion 51 receives when the HP mark 12 is facing the HP sensor.

(3) If the average amount of light reflected by the HP mark 12 decreased by no less than 30% compared to the amount of light reflected by the HP mark 12 immediately after the initialization (Yes in S25), it is to be checked whether or not the HP mark 12 has been soiled and/or damaged.

(4) If the length of time the amount 56 by which the light receiving portion 51 receives the reflected light remained greater than the threshold value A, increased or decreased by no less than 20% (Yes in S26), it is to be checked how bad the soiling of the HP mark 12 and/or damage to the HP mark 12 is, and also, how bad the soiling of the inward surface of the intermediary transfer belt 4 and/or damage to the inward surface of the intermediary transfer belt 4 is.

(5) If the amount 56 by which the light receiving portion 51 receives the reflected light does not exceed while the intermediary transfer belt 4 makes one full rotation (Yes in S27), an error message is displayed.

In step S28, if the number of detection and evaluation operations becomes at least 10, the image forming operation is performed. If the number of detection and evaluation operations is not at least 10, the operation returns to step S22.

If none of the above-described criteria (1)-(5) is met in (S23-S27) (No in S27), an image forming operation is carried out (S29). Then, as the image forming operation ends (No in S30), the sequence ends.

On the other hand, if one or more of the above-described criteria is met in (S23-S27) (Yes in S27), the remaining portion of the image forming operation is suspended. Then, a service person sent from the service department is to turn off the electric power source of the image forming apparatus 100, peel the HP mark 12*b* (top layer) (or transparent protective sheet), and clean the intermediary transfer belt 4.

Incidentally, even after one or more of the criteria (1)-(4) are met, there is a substantial length of time before the image forming apparatus 100 begins to yield a seriously unsatisfactory image or display an error message. Therefore, the message (prompt) displayed on the display/control panel 108 may be cancelled through the display/control panel 108 to continue the remaining portion of the image forming operation. That is, the actual restoring operation may be carried out at the time of the next regular checkup time.

However, if the criterion (5) is met, the message (prompt) cannot be erased through the display/control panel 108. Therefore, it is necessary for a user (operator) to immediately restore the HP mark 12, or ask a service person to make an emergency visit.

Regarding the operational procedure, if a pre-established system for communicating with the terminal located in a service department or store, or a pre-established system for dealing with the problem is in place, it is unnecessary to inform a user of the details of the problem; the image forming apparatus 100 may be placed in the so-called service mode, which is used by a service person through the display/control panel 108, so that the message indicating that the image forming apparatus 100 went into the service mode is displayed on the display/control panel 108.

On the other hand, if a communication system and/or a system for dealing with the above-described situation is not in place, all that can be done is for the user to figure out what might have occurred, and report to a service person. Thus, the problem needs to be described in an easily understandable manner to the user through the display/control panel 108.

Referring to FIG. 24, visiting where the image forming apparatus 100 is operated, a service person studies the message displayed on the display/control panel 108 (S41), and performs a corrective operation in accordance with the message. When the message on the display/control panel 108 is not the error message related to the criterion (5), the service person is to visually inspect the intermediary transfer belt 4 and HP mark 12 (S42). Then, the service person is to determine whether to peel, or simply clean, the HP mark 12*b* (top layer) (S43) and intermediary transfer belt 4.

When the message on the display/control panel 108 indicates that the further usage of the HP mark 12*b* (top layer) is impossible, or the further usage of the HP mark 12*b* (top layer) is impossible because of the deep scar(s) sustained by the HP mark 12*b* (top layer) ("further usage impossible" in S43), the service person is to peel the HP mark 12*b* (top layer) (S44). However, when the message on the display/control panel 108 is a simple warning, or the HP mark 12*b* (top layer) is still usable because it has not been soiled or damaged severely enough to make it unwise to keep on using the HP mark 12 ("acceptable" in S43), the service person is to wipe clean the intermediary transfer belt 4 and HP mark 12 with a piece of unwoven cloth soaked with alcohol (S46). If the soiling cannot be removed by the wiping ("further usage is possible" in S43), the HP mark 12*b* (top layer) is to be peeled (S44).

If it is necessary to peel the HP mark 12*b* (top layer), the HP mark 12*b* (top layer) is to be peeled (S44), and the HP sensor 5 is to be reset in the HP mark detection criteria, following the above-described procedures (S45). The HP mark 12*b* (top layer) and HP mark 12*a* (bottom layer) are different in whiteness, angle of cut, edge properties, thickness, etc. Therefore, even when the intensity level at which a beam of light is emitted by the light emitting portion 52 is kept the same at an intensity level of 55 by the LED control 53, as shown in FIG. 5, the amount 56 of the reflected light received by the light receiving portion 51 becomes different from the amount 56 of the reflected light received when the HP mark 12 was brand-new. This is why the HP sensor 5 has to be initialized reset in the HP mark detection criteria.

However, in a case where the intermediary transfer belt 4 and HP mark 12 are restored by cleaning, the HP sensor 5 does not need to be initialized in the HP mark detection criteria. In other words, the HP mark detection criteria set when the HP sensor 5 was initialized previously can be used to continue the interrupted image forming operation (FIG. 22).

Incidentally, the first embodiment was described with reference to only the case in which the HP mark 12 was made up of the HP marks 12*a* (bottom layer) and 12*b* (top layer). However, even in a case in which the HP mark 12 is made up of the HP mark 12*a* (bottom layer) and transparent protective sheet 12*b* (top layer), the operation and control sequence, which are similar to those described above can be used. In a case where the HP mark 12 made up of the HP mark 12*a* (bottom layer) and transparent protective sheet 12*b* (top layer) is used, the amount 56 of the reflected light, which is received before the HP mark 12*b* (top layer), that is, the transparent protective sheet, is peeled, is different from the amount 56 of the reflected light, which is received after the peeling of the transparent protective sheet 12*b* (top layer). Thus, the HP sensor 5 must also be initialized in the HP mark detection criteria immediately after the peeling of the transparent protective sheet 12*b* in the HP mark detection criteria.

Referring to FIG. 23, which is a flowchart of the image forming operation carried out by the image forming apparatus in this embodiment, if the amount 56 by which the light receiving portion 51 receives the reflected light does not exceed the threshold value A while the intermediary transfer belt 4 makes a single full rotation (S27), an error message is displayed along with the suggestion to notify a service person. However, the message which suggests to peel the HP mark 12*b* (top layer), or transparent protective sheet 12*b* (top layer), may be displayed on the display/control panel 108 (S27) as shown in FIG. 25. In other words, it is possible to prompt (suggest) a user to peel the HP mark (or transparent protective sheet) 12*b* (top layer).

That is, in the first embodiment, a message is displayed on the display/control panel 108, and also, on the terminal display located in a service department or shop, in order to prompt a user to ask a service person to come and restore the image forming apparatus 100. However, a restoration procedure (cleaning or peeling of HP mark 12*b* (top layer)) may be carried out by a user himself.

Further, instead of programming the image forming apparatus 100 so that the condition of the HP mark 12 is automatically diagnosed, the diagnostic program shown in FIG. 23 may be carried out by a service person with the use of the maintenance operation window, in order to display the results of the diagnosis based on the above listed (1)-(5). It is possible to set up a service program so that the condition of the HP mark 12 is regularly checked, and the restoration operation is carried out as necessary. Further, the job of determining whether to clean the HP mark 12 or peeling the HP mark 12 at may be left to a service person.

For example, in the case where the change in the amount of the reflected light was 20%, it does not meet the criterion (3) since the change is less than 30%. However, it is possible that the HP mark 12 have been soiled or scarred, even though it was meet the criterion (3). In such a case, a service person may clean the intermediary transfer belt 4 and HP mark 12*b* (top layer), or peel the HP mark 12*b* (top layer), based on his own judgment; the service person may make a decision case by case.

Further, the checking the condition of the HP mark 12 and intermediary transfer belt 4 may be manually carried out, instead of relying on the automatic process. Manually checking the condition of the HP mark 12 and intermediary transfer belt 4 makes it unnecessary to regularly pull the intermediary transfer belt 4 out of the intermediary transfer belt 4, making it possible to reduce the length of time consumed for servicing the image forming apparatus 100. It can also reduce the image forming apparatus 100 in the length of time consumed for the normal startup of the image forming apparatus 100.

The HP mark 12 in this embodiment is formed of the HP mark 12*a* (bottom layer), and the HP mark 12*b* (top layer) laid on the HP mark 12*a* in the vertical alignment with the HP mark 12*a*. Therefore, if the HP mark 12*b* (top layer) becomes defective, the normal write start signal can be obtained by peeling the HP mark 12*b* (top layer). Further, the problem that the image forming apparatus 100 forms a defective image or displays an error message because of the soiling and/or scarring of the HP mark 12, can be prevented by detecting the extent of the deterioration, and peeling, as necessary, the HP mark 12*b* (top layer) (or transparent protective sheet 12*b*). Thus, this embodiment makes it possible to restart the suspended image forming operation without replacing the intermediary transfer belt 4, which is relatively expensive, that is, without removing or reattaching the intermediary transfer belt 4, which is rather difficult to do.

Further, in this embodiment, the HP mark 12*b* (top layer) is made smaller in the amount of force necessary to peel it than the amount of force necessary to peel the HP mark 12*a* (bottom layer), making it easier for a service person to peel the HP mark 12*b* (top layer) without damaging the HP mark 12*a* (bottom layer). Further, a part of the HP mark 12*b* (top layer) is left uncoated with adhesive. Therefore, the HP mark 12*b* (top layer) is easier for a service person to peel.

Therefore, it was possible to provide the image forming apparatus 100, which is lower in operational cost, and higher in serviceability.

<Characteristic Features of Image Forming Apparatus in First Embodiment of Present Invention>

In the first embodiment of the present invention, the intermediary transfer belt 4, which is an example of an image bearing member, bears a toner image.

The photosensitive drum 3, which is an example of a toner image forming means, forms a toner image on the image bearing member.

The HP sensor 5, which is an example of a detecting means, optically detects the HP mark 12*a*, which is an example of a mark, with which the image bearing member is provided.

The control portion 110, which is an example of a controlling means, controls the toner image forming means, based on the results of the detection of HP mark 12 by the detecting means.

The HP mark 12*b* (top layer), which is an example of a piece of sheet to be detected, is placed on the intermediary transfer belt 4 so that it is overlapped with HP mark 12*a* (bottom layer), which is an example of a mark with which the image bearing member is provided. Further, it is removable from the image bearing member.

The control portion 110, which is an example of a controlling means, can control the toner image forming means, based on the results of the detection of the HP mark 12 by the detecting means, while the HP mark 12*b* (top layer), which is an example of a sheet to be detected, remains on the image bearing member, and after the HP mark 12*b* (top layer) is removed from the image bearing member.

The amount by which the light is reflected by the HP mark 12 (which is an example of a sheet to be detected) while the HP mark 12*b* (top layer) is still on the HP mark 12*a* (bottom layer), and the amount by which the light is reflected by the HP mark 12 after the HP mark 12*b* (top layer) was removed, are greater than the amount by which the light is reflected by the area of the surface of the image bearing member, which is not covered with the HP mark 12.

The HP mark 12*a*, which is an example of a sheet to be detected, is adhered to the image bearing member.

The HP mark 12*b* (top layer), which is also an example of a sheet to be detected, is adhered to the HP mark 12*a*, which is an example of a sheet to be detected.

The adhesive strength of the HP mark 12*b* (top layer) (which is an example of a sheet to be detected) is smaller than the adhesive strength of the HP mark 12*a* (which is an example of sheet to be detected).

The adhesive strength of the front edge portion (in terms of direction in which intermediary transfer belt 4 is moved) of the HP mark 12*b* (top layer) (which is example of sheet to be detected) is smaller than the adhesive strength of the rear edge portion of the HP mark 12*b* (top layer).

Referring to FIG. 23, the control portion 110, which is an example of a controlling means, displays or transmits the information regarding the time for removing a detectable sheet, based on the results of the detection of the HP mark 12 by the detecting means.

Modification 1 of Embodiment 1

Figure 16:
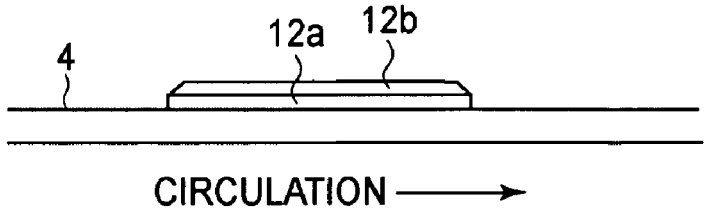
FIGS. 16(*a*)-16(*e*) are schematic sectional views of the second to sixth of the modified versions of the HP mark.
Figure 16:
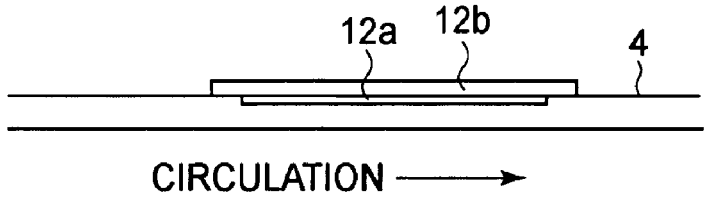
Figure 16:
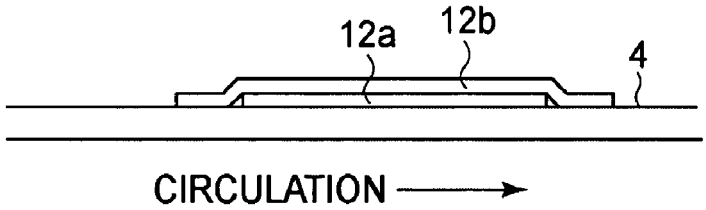
Figure 16:
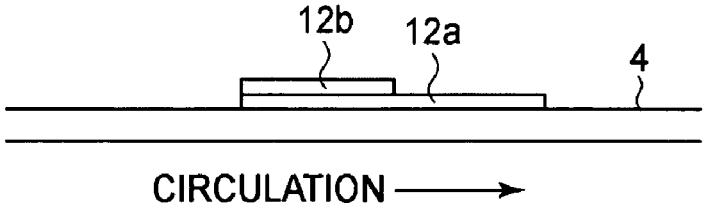
Figure 16:
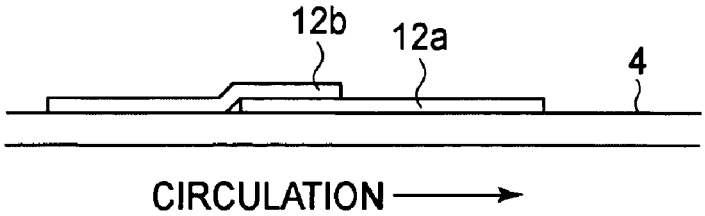

FIG. 15 is a plan view of the first modified version of the HP mark 12*b* (top layer) in the first embodiment, and FIGS. 16(*a*)-16(*e*) are sectional views of the second to the sixth modified versions of the HP mark 12 in the first embodiment, respectively.

Referring to FIG. 15, in terms of the adhesive strength between the HP mark 12*b* (top layer) (or transparent protective sheet 12*b*) and the HP mark 12*a*, the rear end side (rear edge portion) of the HP mark 12*b* (top layer) (or transparent protective sheet 12*b*) is greater than the other area of the HP mark 12*b* (top layer).

The HP mark (or transparent protective sheet) 12*b* (top layer) is provided with multiple portions 12*s*, which are not coated with adhesive. Each portion 12*s* is in the form of a long and narrow rectangle, and extends from the front edge of the HP mark 12*b* (or transparent protective sheet 12*b*) (top layer) slightly beyond the center line of the HP mark 12*b* (in terms of moving direction of intermediary transfer belt 4). In other words, the HP mark 12*b* is characterized in that its front end portion, in terms of the moving direction of the intermediary transfer belt 4, is smaller in the overall size of the portions coated with adhesive, than its rear end portion.

Referring to FIG. 8, in the first embodiment, the HP marks 12*a* and 12*b* are entirely coated with adhesive across one of their two surfaces. Further, referring to FIG. 9(*b*), the adhesive of the HP mark 12*a* adheres to the intermediary transfer belt 4, and the adhesive of the HP mark 12*b* adheres to the entirety of the top surface of the HP mark 12*a* and a part of the intermediary transfer belt 4, which is not covered with the HP mark 12*a*.

Referring again to FIG. 8, the adhesives for the HP marks 12*a* and 12*b* are transparent, and the substrates of the HP marks 12*a* and 12*b* are formed of white sheet (not transparent). Therefore, it is usually impossible to recognize the presence of adhesive on the HP marks 12*a* or 12*b* with the naked eye.

Therefore, some modifications are made to the HP marks 12*a* and 12*b*. More specifically, referring to FIG. 15, the HP mark 12*b* is provided with a mark 12*m*, which is printed on the front end portion of the top surface, that is, the surface which is not coated with adhesive, in order to make it possible to reliably distinguish the surface of the white HP mark 12*a* or 12*b*, which is coated with adhesive, from the surface of the white HP mark 12*a* or 12*b*, which is to be detected by the HP sensor 5, to ensure that the back surface of the HP mark 12*a* or 12*b* is not mistaken for the front surface of the HP mark 12*a* or 12*b*, respectively, when pasting them. The reason for placing said mark 12*m* on the front side of the HP mark 12 is to prevent the mark 12*m* from affecting the manner in which the amount (56 in FIG. 5) by which the light from the light emitting portion 52 is reflected, reduces while the rear end portion of the HP mark 12*b* moves in front of the HP sensor 5.

Referring to FIG. 9(*b*), the adhesive strength between the HP mark 12*a* and intermediary transfer belt 4 needs to be greater across its entirety than the adhesive strength between the HP mark 12*b* and HP marks 12*a*, in order for the HP mark 12*a* to successfully resist the force which works in the direction to peel the HP mark 12*a* from the intermediary transfer belt 4 when the HP mark 12*b* is peeled. The front edge portion of the HP mark 12*b* (top layer) is desired to be made relatively weak in the adhesive strength in order to make it easier to peel the HP mark 12*b* when necessary. This is desirable because the portion of the HP mark 12*b*, to which the primary transfer roller 8 applies a force Fh, which works in the direction to peel the HP mark 12*b*, is only the rear end portion of the HP mark 12*b*, as shown in FIG. 11.

This is why in the first modified version of the first embodiment, the roughly 80% of the HP mark 12*b*, measuring from the front edge of the HP mark 12*b*, is provided with the above-mentioned portions 12*s*, which are in the form of a long and narrow stripe parallel to the moving direction of the intermediary transfer belt 4 and are not coated with adhesive, as shown in FIG. 15. One of the uncompromisable attributes required of the HP mark 12*b* is that the HP mark 12*b* can be peeled from the HP mark 12*a*. Providing the HP mark 12*b* with the above-described portions 12*s* is one of clever means for making it easier to peel the HP mark 12*b* from its front side. If it is necessary to peel the HP mark 12*b*, all that is necessary to be done by a service person is to pull the HP mark 12*b* by pinching the uncoated portion of the HP mark 12*b* with fingers or a pair of tweezers. The above-described mark 12*m* doubles as the mark which indicates the side from which one of the tips of the tweezers is to be inserted between the HP mark 12*b* and HP mark 12*a*.

Providing the HP mark 12*b* with the portions 12*s*, that is, the portions which are in the form of a stripe and are not coated with adhesive, makes it possible to use the same adhesive for the HP marks 12*a* and 12*b*, while differentiating the two HP marks 12*a* and 12*b* in the adhesive strength relative to the surface under them in order to provide them with a proper amount of fastness in terms of the adhesion to the surface under them. The fastness of the adhesion of the HP mark 12*b* to the HP mark 12*a* is made less than the fastness of the adhesion of the HP mark 12*a* to the intermediary transfer belt 4. Therefore, it is ensured that when the HP mark 12*b* is peeled, only the HP mark 12*b* will come off. Thus, this modification of the first embodiment increases the number of adhesives which can be used as the adhesives for the HP marks 12*a* and 12*b*.

The pattern in which adhesive is applied to the HP mark 12*b* to differentiate the HP marks 12*a* from the HP mark 12*b* in the fastness of their adhesion to the surfaces to which they are adhered, by differentiating them in the size of the area to which adhesive is applied, does not need to be limited to the above-described one. For example, a pattern formed of dots or mesh, a pattern formed of a ring or rings, a checkerboard pattern, or the like, may be used as the pattern in which adhesive is applied to the HP mark 12*b*.

Further, if it is desired to make the HP marks 12*b* different from the HP mark 12*a* in the fastness of its adhesion to the surface to which they are adhered, the difference in the fastness of adhesion, which is necessary between the HP marks 12*b* and 12*a*, may be provided by differentiating the adhesive for the HP marks 12*b* from the adhesive for the HP mark 12*a* in terms of the addition or no addition of additive(s), type of additive, and amount of additive, etc.

As long as the HP mark 12*b* is provided with a portion which is easy to peel, it can be easily peeled starting from this portion, even if the adhesive applied to the HP mark 12*b* is fairly large in adhesive strength. The portion of the HP mark 12*b*, which is left free of adhesive may be one of the corners of the front edge of the HP mark 12*b* (in terms of moving direction of intermediary transfer belt 4). In a case where one of the corners of the front edge of the HP mark 12*b* is left free of adhesive, however, it must be ensured that the portion of the HP mark 12*b*, which is free of adhesive, is not pulled back into the area of contact between any of the above-mentioned rollers and the intermediary transfer belt 4. For example, in a case where the size of the substrate of the HP mark 12*b* is 14 $mm^2$, the portion of the HP mark 12*b*, which is to be left uncoated with adhesive, may be roughly 5% in size relative to the entirety of the HP mark 12*b*. The positioning and size of the portion of the HP mark 12, which is to be left uncoated with adhesive, should be optimized in accordance with the choice of the adhesive and the material for the substrate of the HP mark 12*b*, properties of the surface to which the HP mark 12*b* is adhered, amount of pressure to which HP mark 12*b* is subjected, friction between the HP mark 12*b* and the rollers with which the HP mark 12*b* comes into contact. When the combination of the above-described adhesive sheets were tested, the problem that the HP marks 12*b* wraps around the primary transfer roller 8, or the like problem, did not occur as long as the portion of the HP mark 12*b*, which was not coated with adhesive, was no more than 5% of the entirety of the HP mark 12*b*.

Referring to FIG. 16(*a*), in the case of the second modification of the first embodiment, the HP mark 12 is made up of the HP mark 12*a* (bottom layer) and HP mark 12*b* (top layer), which are the same in size. It is made of double-layer adhesive sheet formed of two adhesive sheets by punching. Its HP mark 12*b* (top layer) is chamfered at both the front and rear edges. The front edge is chamfered to make it easier for the primary transfer roller 8, and the like, to roll onto the HP mark 12*b* (HP mark 12) (FIG. 10), whereas the rear edge is chamfered to reduce the amount by which the force Fh is generated in the direction to peel the HP mark 12*b* as the HP mark 12 comes out of the area of contact between the primary transfer roller 8 or the like, and the intermediary transfer belt 4.

Referring to FIG. 16(*b*), in the case of the third modification of the first embodiment, the HP mark 12*a* (bottom layer) is formed as an integral part of the intermediary transfer belt 4. More specifically, it is printed on the intermediary transfer belt 4, or implanted in the intermediary transfer belt 4.

Referring to FIG. 16(*c*), in the case of the fourth modification of the first embodiment, the HP mark 12*b* (top layer) is made longer than the HP mark 12*a* (bottom layer), and is pasted to the intermediary transfer belt 4 and HP mark 12*a* (bottom layer) in such a manner that both the front and rear end portions of the HP mark 12*b* extend on the intermediary transfer belt 4 beyond the front and rear edges of the HP mark 12*a* (bottom layer), respectively.

Referring to FIG. 16(*d*), in the case of the fifth modification of the first embodiment, the HP mark 12*b* (top layer) is made significantly smaller than the HP mark 12*a* (bottom layer), and is pasted to the HP mark 12*a* (bottom layer) in such a manner that the HP mark 12*b* (top layer) is only on the rear portion of the HP mark 12*a* (bottom layer), that is, the portion essential for generating an exposure start timing signal.

Referring to FIG. 16(*e*), in the case of the sixth modification of the first embodiment, the HP mark 12*b* is pasted on the intermediary transfer belt 4 and HP mark 12*a* (bottom layer) in such a manner that the HP mark 12*b* is on the rear portion of the HP mark 12*a*, that is, the portion essential for generating an exposure start timing signal, and the portion of the intermediary transfer belt 4, which is in the immediate adjacencies of the rear edge of the HP mark 12*a* (bottom layer).

Incidentally, it has been confirmed that there are other combinations of materials, which are durable in practical terms than the above-described combination of Material 4 (HP mark 12*a*) and Material 1 (HP mark 12*b*), among the various adhesive sheets evaluated with reference to Table 2. The results of the evaluation of the adhesive sheets as the material for the HP mark 12*b* (top layer), when they were used in combination with Materials 4, 5, 9, and 11 for the HP mark 12*a* (bottom layer), are given in Table 4.

TABLE 4

| Mat. # | Base mat. | T. | Ad. mat. | above 4 | above 5 | above 9 | above 11 |
|---|---|---|---|---|---|---|---|
| 1 | Epoxy film | 0.15 | Heat-curing rubber | 5 | 10 | 0.04 | 5.2 |
| 2 | Polyester | 0.06 | Acrylic | 2.2 | 6.6 | 0.06 | 2 |
| 3 | Polyester | 0.08 | Acrylic | 0.8 | 5.6 | 0.07 | 1.4 |
| 4 | Polyester | 0.06 | Heat-curing rubber | 0.6 | 8 | 0.06 | 5.2 |
| 5 | Polyester | 0.08 | Rubber | 1.6 | 4.8 | 0.04 | 1.4 |
| 6 | Polyester | 0.08 | Acrylic | 1.4 | 3 | 0.02 | 0.8 |
| 7 | U-high molecular w. polyethylene | 0.18 | Rubber | 2.6 | 3.5 | 0.05 | 1.8 |
| 8 | Polyvinyl fluoride | 0.09 | Acrylic | 3 | 7.8 | 0.23 | 4 |
| 9 | Polyester | 0.11 | Rubber | 8 | 24 | 0.7 | 14.0 |
| 10 | U-high molecular w. polyethylene | 0.16 | Acrylic plus adhering | 3.1 | 9.2 | 0.02 | 3.8 |
| 11 | U-high molecular w. polyethylene | 0.28 | Acrylic | 6.8 | 14 | 0.3 | 3.1 |

Table 5 shows the results of the evaluation, in terms of the measured strength of adhesion between Materials 1-8 for the HP mark 12*b*, shown in Table 2, and Materials 4, 5, 9, and 11 for the HP mark 12*a* (bottom layer), shown in Table 2. The strength of adhesion between the material for the HP mark 12*b* and the material for the HP mark 12*a*, was measured by pasting the material for the HP mark 12*b* to the material for the HP mark 12*a*, which is pasted to the intermediary transfer belt 4.

TABLE 5

| | above 4 | | | above 5 | | | above 9 | | | above 11 | | |
|---|---|---|---|---|---|---|---|---|---|---|---|---|
| Mat. # | *1 | *2 | *3 | *1 | *2 | *3 | *1 | *2 | *3 | *1 | *2 | *3 |
| 1 | 5 | G | G | 10 | G | G | 0.04 | N | G | 5.2 | G | G |
| 2 | 2.2 | N | G | 6.6 | G | G | 0.06 | N | G | 2 | N | G |
| 3 | 0.8 | N | G | 5.6 | G | G | 0.07 | N | G | 1.4 | N | G |
| 4 | 0.6 | N | G | 8 | G | G | 0.06 | N | G | 5.2 | G | G |
| 5 | 1.6 | N | G | 4.8 | G | G | 0.04 | N | G | 1.4 | N | G |
| 6 | 1.4 | N | G | 3 | N | G | 0.02 | N | G | 0.8 | N | G |
| 7 | 2.6 | N | G | 3.5 | N | G | 0.05 | N | G | 1.8 | N | G |
| 8 | 3 | N | G | 7.8 | G | G | 0.23 | N | G | 4 | G | G |

*1: adhesion strength
*2: durability
*3: Peeling property
G: good
N: no good

In Table 5, the adhesive strength columns show the actual amount of adhesive strength (N/cm) obtained with the use of a measuring method which will be described later. The duration columns show the evaluation of each material, which was made after the image forming apparatus was continuously operated a substantial length of time at a high temperature level; "G" means that the material is satisfactorily durable, whereas "NG" means that the material is unsatisfactory in durability. The separability columns show the evaluation of each material, which was made by actually peeling the HP marks 12*b*; "G" means that permanent deformation did not occur to the intermediary transfer belt (4 in FIG. 1), whereas "NG" means that permanent deformation occurred to the intermediary transfer belt (4 in FIG. 1).

Adhesive reduces in adhesive strength if it is kept in an ambience which is high in temperature and humidity. Thus, it is possible that if an image forming apparatus is operated for a long time in an ambience which is high in temperature and humidity, the HP mark 12*b* (top layer) will be prematurely peeled by the rollers. Therefore, the combinations shown in Table 5, which were no more than 4.0 N/cm in the strength of adhesion, is unsatisfactory in terms of durability. On the other hand, in the case of the combinations which are no less than 10.0 N/cm in the strength of adhesion, it is highly possible that when it is necessary to peel the HP mark 12*b*, the HP mark 12*b* will fail to smoothly peel, making it possible that the intermediary transfer belt 4 will be permanently deformed by being pulled by the HP mark 12*b*.

Thus, under the restricted condition in the first embodiment, a range of 4-10 N/cm is the proper range for the fastness of the adhesion between the HP mark 12*b* and the surface to which the HP mark 12*b* is pasted.

The combination of Material 11 (HP mark 12*a*) and Material 1 (HP mark 12*b*) was satisfactory in terms of the peelability (separability) and durability of the HP mark 12*b* as well.

Further, the combination of Material 11 (HP mark 12*a*) and Material 4 (HP mark 12*b*) was also satisfactory in terms of the peelability (separability) and durability of the HP mark 12*b*.

Moreover, the combination of Material 11 (HP mark 12*a*) and Material 8 (HP mark 12*b*) was also satisfactory in terms of peelability (separability) and durability of the HP mark 12*b*.

Up to this point, the first embodiment has been described with reference to the HP mark 12, shown in FIG. 1, which is a double-layer HP mark made up of the HP mark 12*b* (top layer) and the HP mark 12*a* (bottom layer), on the top surface of which the HP mark 12*b* is pasted. However, the HP mark 12 may be made up of three or four layered HP marks (subordinate HP marks), as long as it is structured so that the subordinate HP marks can be peeled one by one from the top to restore the HP mark 12 in optical properties, up to three times.

However, increasing the HP mark 12 in the number of the subordinate HP marks increases the overall thickness of the HP mark 12, increasing therefore the amount of the shock to which the primary transfer roller 8 and the like, and the HP mark 12, are subjected when the rollers roll onto the HP mark 12 at the step (height of which equals thickness of HP mark 12) which is located at the rear edge of the HP mark 12. Therefore, it is desired that the HP mark 12 in the first embodiment is no more than 30 μm in thickness, even in case where the HP mark 12 is made up of three or four layers of subordinate HP marks. Further, increasing the HP mark in the number of subordinate HP marks also increases the amount of force necessary to circularly move the intermediary transfer belt 4, in particular, the amount of force necessary to move the HP mark 12 through the area of contact between the primary transfer roller 8 or the like, and the intermediary transfer belt 4, since the roller 8 or the like has to be lifted onto the HP mark 12 at the front edge (step) of the HP mark 12. Therefore, when increasing the HP mark 12 in the number of the subordinate HP marks, the effect which the increase has on the durability of an image forming apparatus has to be seriously taken into consideration.

Further, in order to ensure that the subordinate HP marks can be peeled one by one from the top in an orderly manner, the closer the subordinate HP mark to the intermediary transfer belt 4, the greater it has to be in the fastness of its adhesion to the subordinate HP mark under it. For example, in a case where the HP mark 12 is made up of three subordinate HP marks, the following relationships have to satisfied:

(1) In terms of the fastness of the adhesion, Top subordinate HP mark<middle subordinate HP mark<bottom subordinate HP mark.

(2) Positional deviation (attributable to load)=0-1 mm.

For example, in a case where the HP mark 12 is made up of the HP mark 12*a* (example of subordinate HP mark), and two HP marks 12*b* (subordinate HP marks) layered on the HP mark 12*a*, the HP mark 12*b* (middle layer), which is an example of the first sheet to be detected, is pasted so that it overlaps with the HP mark 12*a* (bottom layer). The HP mark 12*b* (top layer), which is the second sheet to be detected, is pasted to the surface of the HP mark 12*b* (middle layer), which faces the HP mark 12*a*. The HP mark 12*b* (top layer), which is the example of the second sheet to be detected, is smaller in adhesive strength than the HP mark 12*b* (middle layer), which is the first sheet to be detected.

Incidentally, all that is necessary is for the adjacent two layers of HP marks to satisfies the above described relationship when the topmost HP mark is peeled from the HP mark immediately under the topmost HP mark. Initially or during an image forming operation, the adhesion between the topmost subordinate HP mark and the subordinate HP mark immediately under the topmost subordinate HP mark is desired to be as fast and durable as possible. That is, the above described relationships may be satisfied by processing the HP mark with heat or ultraviolet rays, more specifically, processing in advance the top and middle subordinate HP marks with ultraviolet rays and heat, respectively, when manufacturing the HP mark 12, as will be described later.

Embodiment 2

In the second embodiment, the HP mark 12 is made up of the HP mark 12*a* (bottom layer) (formed of opaque white sheet) in the first embodiment described with reference to FIGS. 1-16, and a transparent protective sheet, instead of the HP mark 12*b*. Otherwise, the HP mark 12 in this embodiment is the same in structure as the HP mark 12 in the first embodiment. Therefore, the second embodiment will be described with reference with also FIGS. 1-16. Thus, in the following description of the second embodiment of the present invention, the HP mark 12*b* is to be understood as a transparent protective sheet 12*b*.

In the first embodiment, the structure of the HP mark 12 is such that the HP mark 12*b* (top layer), which was opaquely white, was pasted on the HP mark 12*a* (bottom layer), which was also opaquely white. However, the HP mark 12 may be made by pasting the transparent protective sheet 12*b* (example of transparent protective member) on the HP mark 12*a* (bottom layer), as shown in FIG. 9(*b*), in such a manner that the transparent protective mark 12*b* (top layer) can be peeled as necessary.

It is possible that it will become impossible for the HP mark 12*b* to be normally detected, because the transparent protective sheet 12*b* has been severely soiled, or has become opaque because of the frictional scars or the like. If such a problem occurs, the aged transparent protective sheet 12*b* is to be peeled to expose the HP mark 12*a* (bottom layer), which is white. After the exposure, the HP mark 12*a* is greater in reflectivity than a brand-new HP mark 12, which is made up of the brand-new HP mark 12*a* and the brand-new transparent protective sheet 12*b*, and also, in the contrast between the its rear edge and inward surface of the intermediary transfer belt 4. Therefore, the exposure start timing can be more accurately set.

There are various white opaque adhesive sheets, including the adhesive sheets shown in Tables 2 and 3 used for the description of the first embodiment, which can be obtained as the materials for the HP mark 2*a* and transparent protective sheet 2*b*. However, the adhesive sheet as the material for the transparent protective sheet 12*b* is desired to be such an adhesive sheet that is no less than 90% in the overall transparency, that is, the transparency of the combination of the transparent protective sheet 12*b* and its adhesive layer.

As long as the relationship between the transparent protective sheet 12*b* and HP mark 12*a* (bottom layer) in terms of adhesive strength satisfies the conditions as does the relationship between the HP mark 12*b* (top layer) and HP mark 12*a* (bottom layer) in the first embodiment, the HP mark 12 is satisfactory in terms of both the peelability (separability) and durability, which the transparent protective sheet 12*b* requires.

(1) Adhesive strength transparent protective sheet 12*b*<adhesive strength of HP mark 12*a* (bottom layer), (2) Adhesive strength of transparent protective sheet 12*b*=4-10 (N/cm), (3) Fastness of adhesion (positional deviation)=0-1 (mm).

In a case where Material 4 in Table 2 is used as the adhesive sheet for the HP mark 12*a* (bottom layer), the transparent adhesive sheets, which are no less than 4.0 N/cm, and no more than 6.6 N/cm, in the fastness of adhesion, are the good candidates for the materials for the transparent protective sheet 12*b*. For example, Super 10 (registered trade name) of Sumitomo 3M Ltd.), which is 150 μm in overall thickness satisfies the above listed criteria.

<Characteristic Features of Image Forming Apparatus in Second Embodiment of Present Invention>

The transparent protective sheet 12*b* (top layer), which is an example of a transparent sheet, through which the beam of light projected by the detecting means can transmit, is placed on the intermediary transfer belt 4 so that it overlaps with HP mark 12*a* (bottom layer) on the intermediary transfer belt 4. Further, it is removable from the image bearing member.

The control portion 110, which is an example of a controlling means, can control the toner image forming means, based on the results of the detection of the HP mark by the detecting means, while the transparent protective sheet 12*b* (top layer), which is an example of a transparent sheet, remains on the image bearing member, and after the transparent protective sheet 12*b* (top layer) is removed from the image bearing member.

The amount by which the light is reflected by the HP mark 12 (which is an example of a sheet to be detected) while the transparent protective sheet 12*b* (top layer) is still on the HP mark 12*a* (bottom layer), and the amount by which the light is reflected by the HP mark 12 after the transparent protective sheet 12*b* (top layer) was removed, are greater than the amount by which the light is reflected by the area of the surface of the image bearing member, which is not covered with the HP mark 12.

The HP mark 12*a*, which is an example of a mark to be detected, is adhered to the image bearing member.

The transparent protective sheet 12*b*, which is also an example of a transparent sheet, is adhered to the HP mark 12*a*.

The fastness of adhesion between the transparent protective sheet 12*b* (which is example of transparent sheet) and the HP mark 12*a*, is less than the fastness of adhesion between the HP mark 12*a* (which is example of mark to be detected) and the intermediary transfer belt 4.

For example, in a case where two transparent sheets 12*b* are pasted in layers on the HP mark 12*a*, which is an example of a mark, the transparent protective sheet 12*b* (middle layer), which is an example of a first transparent sheet, is pasted on the HP mark 12*a* in a manner to be perfectly aligned in the "vertical direction" with the HP mark 12*a*. The transparent protective sheet 12*b* (top layer), that is a second transparent sheet, is adhered on the opposite surface of the first transparent sheet from the surface which faces the HP mark 12*a*. The fastness of the adhesion of the transparent protective sheet 12*b* (top layer), that is, an example of the second transparent sheet, to the transparent protective sheet 12*b* (middle layer), is less than the fastness of the adhesion of the transparent protective sheet 12*b* (middle layer) to the HP mark 12*a*.

Embodiment 3

Figure 17:
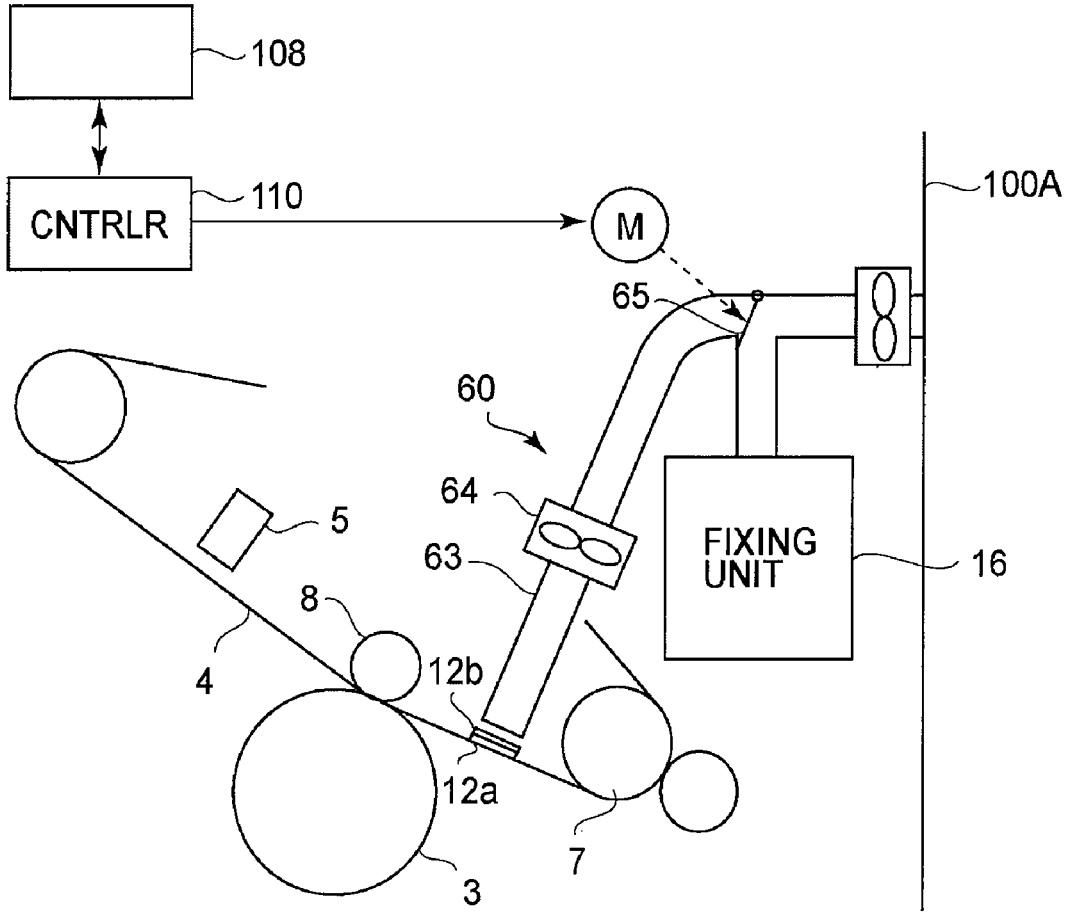
FIG. 17 is a schematic sectional view of the system for heating the HP mark 12*b*, that is, the top layer of HP mark, which becomes easily peelable as it is heated, showing the structure of the system.
Figure 18:
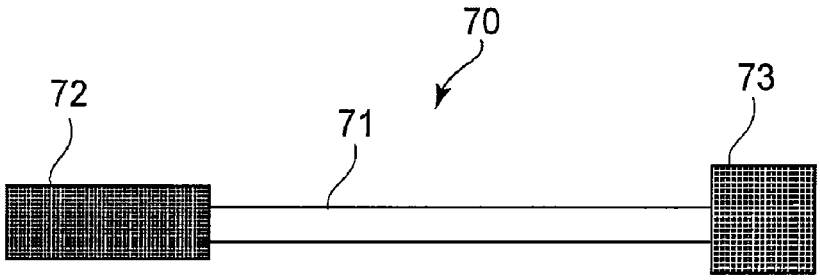
FIG. 18 is a schematic drawing of the heating jig.

FIG. 17 is a schematic sectional view of the system, in the third embodiment, for heating the top HP mark in order to peel the top HP mark. FIG. 18 is a schematic drawing of the heating jig. The third embodiment is different from the first embodiment, which was described with reference to FIGS. 1-16, in that the adhesive used in this embodiment for the HP mark 12*b* (top layer) is an adhesive of the so-called hot-melt type, that is, an adhesive which loses its adhesive strength by being heated. Otherwise, the third embodiment is the same as the first embodiment. Therefore, the third embodiment will be described with reference to also FIGS. 1-16. However, the HP mark 12*b* in these drawings is to be understood as an HP mark 12*b*, the adhesive of which is an adhesive of the hot-melt type.

In this embodiment, the HP mark 12*b* (top layer) or transparent protective sheet 12*b* (top layer) is pasted with the use of an adhesive which reduces in adhesiveness as it is irradiated with ultraviolet rays, or it is heated.

A heating apparatus 60, which is an example of a means for removing the HP mark or transparent protective sheet, is positioned so that it faces the path of the HP mark 12 of the intermediary transfer belt 4. The heating apparatus 60 is for heating the HP mark 12*b* (top layer) or transparent protective sheet 12*b*.

In the first embodiment, the relationship (inequality) "adhesive strength of HP mark 12*b* (top layer)<adhesive strength of HP mark 12*a* (bottom layer)" is satisfied in the normal ambience, that is, an ambience which is normal in temperature and humidity, in the normal ambience in which an image forming apparatus is repaired, and also, under the normal lighting. However, the above described relationship between the adhesive strength of the HP mark 12*b* (top layer) and the adhesive strength of the HP mark 12*a* (bottom layer) may be satisfied by heating the HP mark 12 (12*b* (top layer)) before peeling the HP mark 12*b* (top layer). As long as the above described relation remain satisfied while the HP mark 12*b* (top layer) is actually peeled, there will be no problem when peeling the HP mark 12*b* (top layer).

In a case where adhesives which reduce in adhesiveness as they are heated are used as the adhesives for this embodiment, the HP mark 12*b* or transparent protective layer 12*b* does not need to be easy to peel until they are heated. In the normal environment, the HP marks which uses adhesives of the so-called hot-melt type (which hereafter will be referred to simply as hot-melt adhesives) are hard to peel. However, as the ambient temperature increases, they become easier to peel. Thus, this property of the hot-melt adhesive is utilized to make it easier to peel the HP mark 12*b* (top layer). The difference of this embodiment from the first embodiment is the difference of the adhesives used in this embodiment from those used in the first embodiment in terms of their thermal properties. Next, therefore, hot-melt adhesives will be described in detail.

In terms of adhesive ingredients, adhesives can be classified into a rubber group, an acrylic group, a silicone group, etc. As will be evident from the description of the first embodiment, acrylic adhesives are strongest in adhesive strength. The rubber adhesives and silicone adhesives are roughly the same in adhesive strength. In terms of the state in which adhesive has to be when applied, adhesives can be classified into a solution group, an emulsion group, a hot-melt group, a thermally spreadable group, a solvent-free irradiation group, a water solution group, etc.

The adhesive used in this embodiment for the HP mark 12*b* (top layer) (or transparent protective sheet 12*b*) is a hot-melt adhesive, that is, an adhesive which softens, making it easier to peel the HP mark 12*b* or transparent protective layer 12*b*, as it is heated. As ambient temperature rises, hot-melt adhesive reduces in viscosity, as defined in JIS K2351. Thus, the adhesive used in this embodiment can be uniformly applied to a thickness of roughly 20 μm with the use of a coating machine called a die coater. The HP mark 12*b* should be placed on the HP mark 12*a* before the hot-melt adhesive applied to the HP 12*b* cools down. Once the applied hot-melt adhesive is cooled down to the normal temperature level, it displays a high level of fastness of adhesion.

When it is the time for the HP mark 12*b* (top layer) to be peeled, the HP mark 12*b* (top layer) is to be heated while remaining adhered to the HP mark 12*a* (bottom layer) in order to increase in temperature the hot-melt adhesive between the HP mark 12*b* (top layer) and HP mark 12*a* (bottom layer), to a level higher than its softening point. As the temperature of the hot-melt adhesive increases beyond its softening point, the adhesive becomes ineffective as adhesive, allowing thereby the HP mark 12*b* (top layer) to be easily peeled away from the Hp mark 12*a* (bottom layer). In other words, the HP mark 12*b* (top layer) can be easily peeled from the HP mark 12*a* (bottom layer) by being heated.

Further, it is feasible to adhering the HP mark 12*a* (bottom layer) to the intermediary transfer belt 4 with the use of a hot-melt adhesive which is relatively higher in the softening point, and adhere the HP mark 12*b* (top layer) to the HP mark 12*a* (bottom layer) with the use of a hot-melt adhesive which is relatively low in the softening point. In a case where a hot-melt adhesive which is relatively low in softening point and a hot-melt adhesive which is relatively high in softening point are used for the HP marks 12*b* (top layer) and 12*a* (bottom layer), respectively, the HP mark 12*b* (top layer) can be easily peeled away from the HP mark 12*a* (bottom layer) by heating the HP mark 12 to a temperature level which is between the two softening points. JIS K2351 lists various adhesives which are different in the softening point.

The main ingredient of the hot-melt adhesive used in the third embodiment is Moresco-Melt PB-60 (registered trade name) of Matsumura Oil Research Corp. (registered name), and its softening point is 92° C. The highest ambient temperature to which the intermediary transfer belt 4 of the image forming apparatus 100 shown in FIG. 1 is subjected is 55° C. Thus, the hot-melt adhesive used in this embodiment maintains its adhesive strength (12-14 N/cm) during a normal image forming operation.

Referring to FIG. 17, the apparatus main assembly 100A is provided with the heating apparatus 60 which utilizes the heat exhausted from the fixing unit 16. The heating apparatus 60, which is an example of an apparatus for facilitating the removal of the HP mark 12*b* (top layer) (or transparent protective sheet), reduces the HP mark 12*b* (top layer) (or transparent sheet) in adhesive strength. In the normal operation, the heating apparatus 60 switches the direction in which the air heated by the fixing unit 16 is exhausted from the fixing unit 16, with the use of a valve 65, so that the heated air is exhausted through a duct 63 by a fan 64.

When it is necessary to peel the HP mark 12*b* (top layer), a service person is to input a command for removing the HP mark 12*b*, with the use of the display/control touch panel 108. Responding to this command, the control portion 110 stops the intermediary transfer belt 4 so that the HP mark 12*b* faces the duct 63. Then, it changes the value 64 in position, and starts the fan 64. With the elapse of a certain length of time from the starting of the heating apparatus 60, the control portion 110 displays a message which indicates that the HP mark 12*b* is ready to be peeled, on the display/control panel 108.

The temperature of the heating portion of the fixing unit 16 is roughly 180° C. With the heating apparatus 60 structured, as described above, so that the heated air from the fixing unit 16 is aimed at the HP mark 12*b* by the combination of the fan 64 and duct 63, the air temperature at the position of the HP mark 12*b* reaches 80° C. to 100° C. However, during the normal operation of the image forming apparatus 100, the heated air exhausted from the fixing unit 16 is not exhausted by way of the fan 64 and duct 63. Therefore, for a certain length of time after the heated air begins to be exhausted by the fan 64, the heat of the heated air from the fixing unit 16 is absorbed by the components in the adjacencies of the passage of the heated air. Thus, it is necessary for a user (operator) to wait roughly a minute before the user attempts to peel the HP mark 12*b*.

The HP mark 12*b* (or transparent protective sheet 12*b*), the adhesive of which is Moresco-Melt PB-60 (registered trade name), remains below 0.5 N/cm in the amount of force necessary to peel the HP mark 12*b* (which hereafter will be referred to as "peel force") for 10 seconds or so even after its temperature fell below the softening point of the adhesive. Thus, it is this period of time that a service person is to peel the HP mark 12*b*.

With the employment of the above-described hot-melt adhesive as the adhesive for the HP mark 12*b*, it was possible to provide the HP mark 12*b* (or transparent protective sheet 12*b*), which remains superior in adhesive strength and durability during a normal image forming operation, but, becomes easily peelable by being heated, when it needs to be peeled.

Incidentally, the adhesive strength of an adhesive is affected by temperature even if the adhesive is not a hot-melt adhesive. Moresco-Melt PB-60 (registered trade name) is an example of a hot-melt adhesive. That is, the adhesive to be used as that for the HP mark 12*b* (or transparent protective sheet 12*b*) may be an adhesive other than Moresco-Melt PB-60. For example, a hot-melt adhesive, or combinations of hot-melt adhesives, for the HP mark 12*b* (or transparent protective sheet 12*b*), which allow the HP mark 12*b* to be easily peeled by being heated, can be provided by formulating adhesives with reference to the softening point of each of the main ingredients therefor, and then, actually measuring the formulated adhesives in terms of the adhesive strength at various temperature levels while changing the substrate of the HP mark 12*b* in material, and also, changing the object to which the HP mark 12*b* is adhered. Further, image forming apparatuses are different in the temperature of the ambience in which they are operated, and the fixation fixing temperature. Therefore, the range of the softening point of a hot-melt adhesive should not be limited to the above described one.

Even in a case where an image forming apparatus does not have the heating apparatus 60 shown in FIG. 17, it is possible to use the HP mark 12*b* (top layer) (or transparent protective sheet 12*b*) which can be easily peeled by being heated. Even in the case such as the above, an operation similar to the above described operation for peeling the HP mark 12*b* (top layer) can be carried out by bringing a heating device, such as a dryer, a hot air jetting apparatus, a heater, or the like, into a job site.

Further, the image forming apparatus 100 shown in FIG. 1 may be provided with a heating jig, such as the one shown in FIG. 18, which is an example of a means for facilitating the removal of the HP mark 12*b*. In a case where the apparatus 100 is provided with the above-mentioned jig, the apparatus 100 does not need to be structured to guide the heated air exhausted from the fixing unit 16, toward the HP mark 12*b*. More specifically, the heating jig 70 is made up of a grip 72, a rubber pad 73, and a plastic rod 71, as shown in FIG. 18. The grip 72 is formed of rubber, which is effective to prevent heat transmission. The rubber pad 73 is formed of silicone rubber, which is used also in the fixing unit 16 or the like. The plastic rod 71 connects the grip 72 and rubber pad 73. In other words, the heating jig 70 is very simple in structure. It is used in the following manner. That is, a service person is to place the rubber pad 73 of the heating jig 70 on the heating portion of the fixing unit 16 by holding the heating jig 70 by the grip 72, in order to transfer heat from the fixing unit 16 to the rubber pad 73. Then, the service person is to press the heated rubber pad 73 upon the HP mark 12*b* (top layer) (or transparent protective sheet 12*b*) shown in FIG. 17 to soften the hot-melt adhesive of the HP mark 12*b*. Then the service person is to peel the HP mark 12*b* (top layer) after confirming that the adhesive has softened. The heating jig 70 may be designed to be removably attachable to the image forming apparatus 100, or to be carried by a service person.

Embodiment 4

Figure 19:
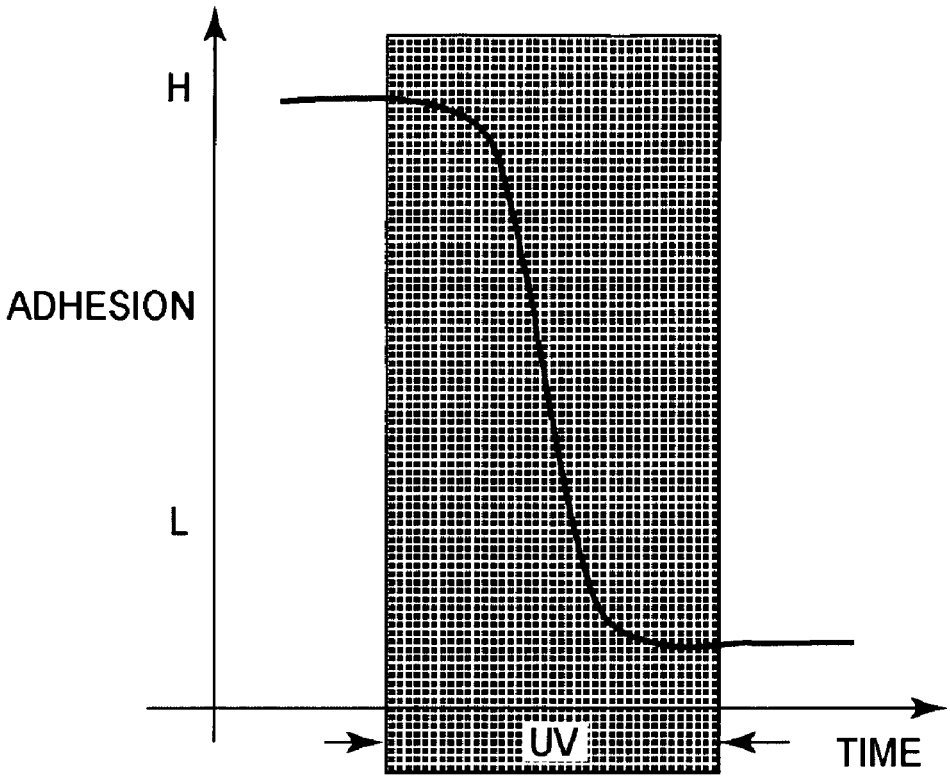
FIG. 19 is a graph of the relationship between the adhesive strength of an adhesive which can be softened by ultraviolet rays, and the length of time the adhesive is irradiated with ultraviolet rays.
Figure 20:
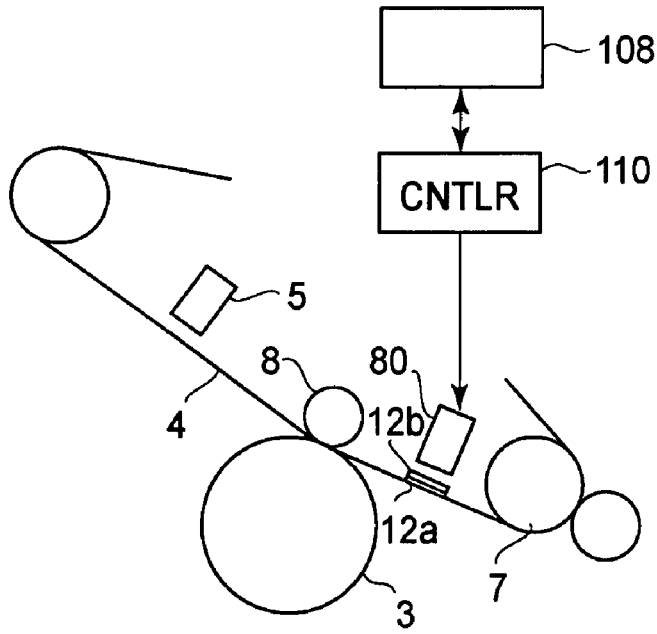
FIG. 20 is a schematic drawing of a system for irradiating an HP mark with ultraviolet rays, showing the structure of the system.

FIG. 19 is a graph showing the relationship between the adhesive strength of an adhesive which can be softened by ultraviolet rays, and the length of time the adhesive is irradiated with ultraviolet rays. FIG. 20 is a schematic drawing of the system for irradiating the HP mark 12*b* with ultraviolet rays. The fourth embodiment is different from the second embodiment, which was described with reference to FIGS. 1-16, in that the adhesive used in this embodiment for adhering the HP mark 12*b* (top layer) (or transparent protective sheet 12*b*) is a piece of adhesive tape, which significantly reduces in adhesiveness as it is irradiated by ultraviolet rays. Otherwise, this embodiment is the same as the second embodiment. Therefore, the fourth embodiment will be described with reference to also FIGS. 1-16. However, the HP mark 12*b* in these drawings is to be understood as a HP mark 12*b* adhered with the use of a piece of tape which significantly reduces in adhesive strength as it is irradiated with ultraviolet rays.

In the fourth embodiment, the relationship (inequality) "adhesive strength of transparent protective sheet 12*b*<adhesive strength of HP mark 12*a* (bottom layer)" is satisfied by irradiating the transparent protective sheet 12*b* with ultraviolet rays before attempting to peel the transparent protective sheet 12*b*. As long as the above described relationship remain satisfied while the HP mark 12*b* (top layer) is actually peeled, there will be no problem when peeling the HP mark 12*b* (top layer). Further, it is assumed that after the transparent protective sheet 12*b* is peeled, it is discarded. Therefore, such adhesive tape that changes in molecular structure and irreversibly and drastically reduces in adhesive strength as it is irradiated with ultraviolet rays, may be used as the means for adhering the transparent protective sheet 12*b*.

In the fourth embodiment, adhesive tape which is used as the dicing tape for a semiconductor exposing apparatus, and which become easily peelable as it is irradiated with ultraviolet rays for a certain length of time, or the like tape, is used as the means for adhering the transparent protective sheet 12*b* to the HP mark 12*a* (bottom layer). More concretely, Tape No. 68602 (commercial name) (which becomes peelable as it is irradiated with ultraviolet rays, and will be referred hereafter as UV sensitive tape), that is, a product of Sliontec Co., Ltd. (registered name) was used.

Referring to FIG. 19, this adhesive tape, which becomes peelable as it is irradiated with ultraviolet rays, is 0.11 mm in the overall thickness, and is 4.2 N/cm in the adhesive strength before it is irradiated with ultraviolet rays. However, as it is irradiated with ultraviolet rays which is no more than 100 $mW/cm^2$ in intensity, and by an amount of 1000 $mJ/cm^2$, it reduces in adhesive strength to as low as 0.2 N/cm.

Referring to FIG. 20, the image forming apparatus 100 in this embodiment is provided with an ultraviolet ray source 80, which is placed in the same position as the position in which the heating apparatus 60 is placed in the third embodiment. The ultraviolet ray source 80, which is another example of a means for facilitating the removal of the transparent protective sheet 12*b*, reduces the transparent protective sheet 12*b* or HP mark 12*b* in adhesive strength. In this embodiment, a light emitting element I-LED NCCU033 (registered trade name), a product of Nichia Corporation is used as the ultraviolet ray source 80. By setting the target intensity level at which ultraviolet rays is emitted by the ultraviolet ray source 80 to 50 $mW/cm^2$, and the target amount to 500 $mJ/cm^2$, the adhesive strength of the transparent protective tape or HP mark 12*b* can be reduced to the desired level in 10 seconds. Therefore, there is no problem in terms of the length of time necessary for the operation for peeling the HP mark 12*b* or transparent protective sheet 12*b*.

There is the following relationship:

$$J=W\times s$$

J: amount of energy irradiated.

W: intensity of flux of ultraviolet rays.

s: length of time (in seconds) ultraviolet rays are emitted.

As a service person inputs a command for removing the transparent protective sheet 12*b*, with the use of the display/control touch panel 108, the control portion 110 stops the intermediary transfer belt 4 so that the HP mark 12*b* faces the ultraviolet ray source 80. Then, it turns on the ultraviolet ray source 80 for 10 seconds. Then, the control portion 110 displays a message which indicates that the transparent protective sheet 12*b* is ready to be peeled, on the display/control panel 108.

Incidentally, instead of providing the image forming apparatus 100 with the ultraviolet ray source 80, a portable device capable of emitting ultraviolet rays, which is an example of a means for facilitating the removal of the transparent protective sheet 12*b*, may be brought into the place where the transparent protective sheet 12*b* is to be peeled, in order to peel the transparent protective sheet 12*b* by irradiating the transparent protective sheet 12*b* with ultraviolet rays.

Regarding the material for the transparent protective sheet 12*b*, in addition to Sliontec Corp (registered name), Somar Corp. (registered name), Sekisui Chemical Co., Ltd. etc., have also developed adhesive sheets, which become peelable (separable) as they are irradiated with ultraviolet rays. The adhesive tap developed by the latter is SELFA (commercial name).

Embodiment 5

Figure 21:
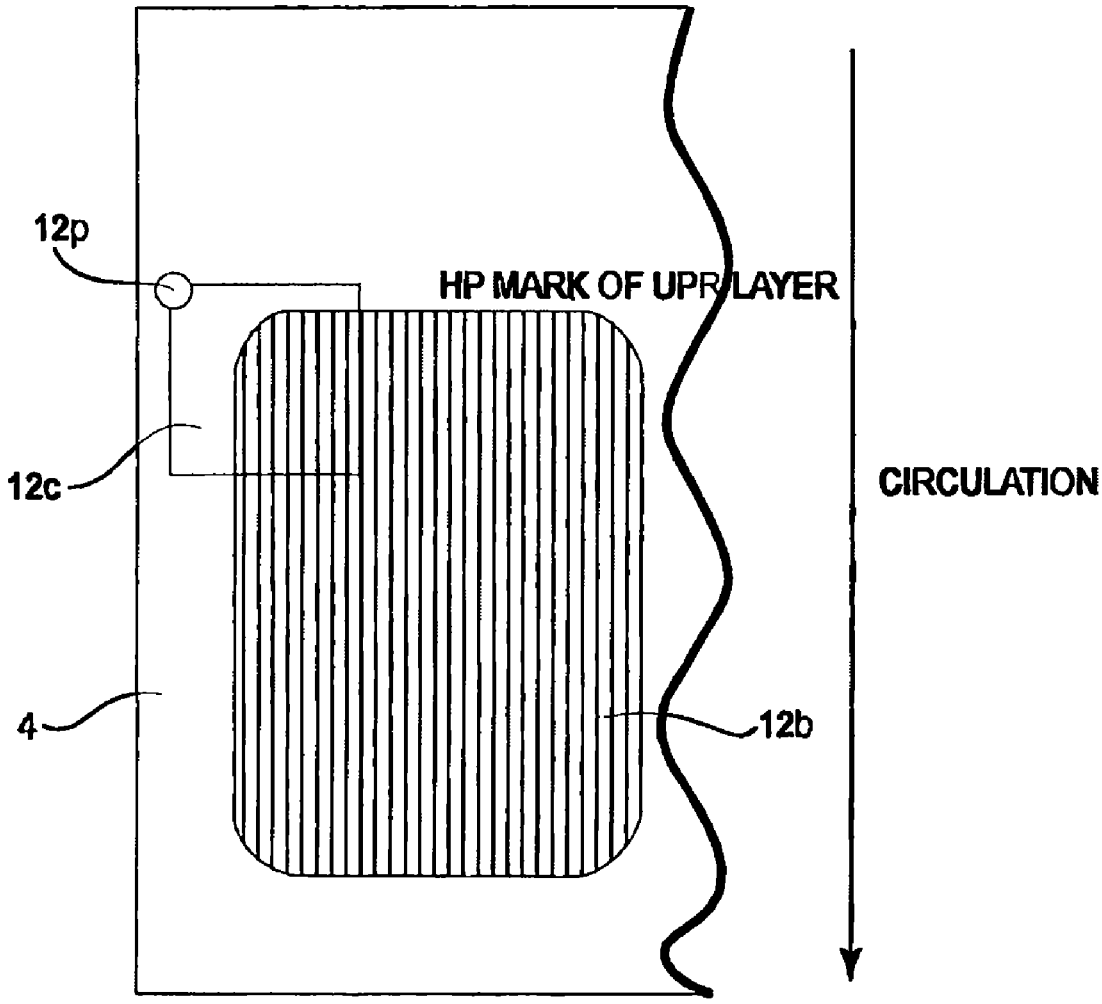
FIG. 21 is a schematic drawing of a member for facilitating the peeling of the top layer of the HP mark, HP mark, and intermediary transfer belt 4, showing the method for using the member.

FIG. 21 is a schematic drawing showing the method for using the member for facilitating the peeling of the HP mark 12*b* (or transparent protective sheet 12*b*). The fifth embodiment is different from the first embodiment, which was described with reference to FIGS. 1-16, in that in this embodiment, a member for facilitating the peeling of the HP mark 12*b* (top layer) is used to peel the HP mark 12*b*.

In the case of the modified version of the HP mark 12*b* in the first embodiment, which is shown in FIG. 15, the HP mark 12*b* (top layer) were left partially uncoated with adhesive so that it can be easily peeled without a tool dedicated for peeling the HP mark 12*b* (top layer), for the following reason. That is, while the intermediary transfer belt 4 is circuitously moved, it is repeatedly bent and stretched, and also, is repeatedly stepped on by the primary transfer rollers 8, etc. Therefore, it is not feasible to provide the HP mark 12*b* (top layer) with a tab for peeling the HP mark 12*b* (top layer).

However, the first modified version of the HP mark 12*b* in the first embodiment requires a complex manufacturing process, being therefore higher in cost. In the fifth embodiment, therefore, the HP mark 12*b* (top layer) is designed so that a tab (removal facilitation member) can be attached to the HP mark 12*b* (top layer) when it is necessary to peel the HP mark 12*b* (top layer).

More specifically, referring to FIG. 21, the HP mark 12*b* (top layer) is evenly coated with adhesive across one of the surfaces, and is pasted to the HP mark 12*a* (bottom layer) (FIG. 9) and intermediary transfer belt 4. When the HP mark 12*b* (top layer) needs to be peeled, a service person is to paste an HP mark removal facilitation member 12*c* to one of the rear corners of the HP mark 12*b* (top layer). Then, the service person is to peel the HP mark 12*b* by lifting the HP mark removal facilitation member 12*c* by its corner 12*p*.

The HP mark removal facilitation member 12*c* is formed of an adhesive sheet which is greater in adhesive strength than the HP mark 12*b*. It is pasted to both the HP mark 12*b* and intermediary transfer belt 4 in a manner to cover the edge of one of the rear corner of the HP mark 12*b*. However, when pasting the HP mark removal facilitation member 12*c*, the service person is to hold the abovementioned corner portion 12*p* of the member 12*c*, with a finger of the left hand, and apply pressure to the rest of the member 12*c*, with a finger of the right hand. After the pressing, the service person is to lift the corner portion 12*p*, and the HP mark removal facilitation member 12*c* (which hereafter will be referred to as peeling tab 12*c*) at a rather slow speed (roughly 300 mm/min). It should be noted here that when peeling the HP mark 12*b*, close attention must be paid to prevent the intermediary transfer belt 4 becoming creased or wrinkled. The operational steps and the order in which they are to be carried out are shown on the backside of the lid of the apparatus main assembly 100A (FIG. 1), or on the display/control panel 108.

The adhesive strength of the peeling tab 12*c* to the HP mark 12*b* is no less than 10 N/cm, being rather high. However, as the adhesive for the peeling tab 12*c*, an adhesive which is unlikely to adhere to polyimide is selected. Therefore, it does not occur that when the HP mark 12*b* is peeled, the intermediary transfer belt 4 is damaged or soiled. For example, Polyester Tape No. 859 (commercial name), a product of Sumitomo 3M Co., Ltd., is 19.6 N/cm in adhesive strength, and yet, does not adhere to polyimide. Thus, it is usable as the material for the peeling tab 12*c*.

<Miscellaneous Embodiments Employing Recording Medium Conveying Member>

Referring to FIG. 1, in the first to fifth embodiments, the HP mark 12 is placed on the inward surface of the intermediary transfer belt 4.

However, they are not intended to limit the application of the present invention to an image forming apparatus employing an intermediary transferring member, inclusive of the intermediary transfer belt 4. For example the present invention is also applicable to the image forming apparatus, disclosed in Patent Document 2, which employs a recording medium conveying member, such as a recording medium conveying belt, the outward surface of which is provided with an HP mark. That is, the HP mark or transparent protective sheet may pasted in layers to the HP mark on the recording medium conveying member, so that the HP mark can be restored in optical properties, without replacing the recording medium conveying member, in order to ensure that images are formed with the normal timing.

In the case of a full-color image forming apparatus of the tandem type, that is, an image forming apparatus having multiple photosensitive drums arranged in tandem along its recording medium conveying belt, each photosensitive drum, which is an example of an image bearing member, bears a toner image.

The primary charging apparatuses, exposing apparatuses, and developing apparatuses of the image forming apparatus, which are examples of a toner image forming means, form a toner image on the corresponding bearing member.

The recording medium conveying belt of the image forming apparatus, which is an example of a recording medium conveying member bears a recording medium.

The transferring apparatus, which is an example of a transferring means, transfers the toner image on each image bearing member, onto the recording medium on the recording medium bearing member.

The sensor for detecting the reflected light, which is an example of a detecting means, optically detects the mark on the recording medium bearing member.

The control portion which is an example of a controlling means, controls the image forming means, based on the results of the detection of the mark by the detecting means.

The transparent protective sheet 12*b*, which is an example of a transparent sheet, transmits the beam of light emitted by the detecting means, and is placed on the mark on the recording medium conveying member, in perfect alignment with the mark.

The transparent protective sheet 12*b*, which is an example of a transparent sheet, is removable from the recording medium conveying member.

The controlling means can control the image forming means, based on the results of the detection of the mark by the detecting means, while the transparent protective sheet 12*b* which is an example of a transparent sheet remains on the recording medium conveying member, and also, after the removal of the transparent protective sheet 12*b*.

Further, it is possible to place an HP mark 12*b* (which is example of HP mark), instead of the transparent protective sheet 12*b*, on the HP mark 12*a* on the outward surface of the recording medium conveying member of the above described image forming apparatus of the tandem type.

The HP mark 12*b* (top layer), which is an example of a sheet to be detected, is removable from the recording medium conveying member.

The control means can control the image forming means, based on the results of the detection of the mark by the detecting means, while the transparent protective sheet 12*b* which is an example of a transparent sheet, remains on the recording medium conveying member, and also, after the removal of the transparent protective sheet 12*b*.

Other Examples of Modification

The application of the present invention is not limited to an HP mark placed on the inward surface of an intermediary transfer member or recording medium conveying member. For example, the present invention is also applicable to an HP mark which is placed on the outward surface of an intermediary transfer member or recording medium conveying member, which is likely to be scarred by rotating members as it comes into contact with them, or is likely to become soiled by foreign matter.

The application of the present invention which relates to a mark to be detected, and the method for restoring a mark to be detected, in optical properties, by peeling the top layer of the mark, which is the same as the bottom layer of the mark, or the transparent protective layer placed on the bottom layer of the mark, is not limited to an HP mark. That is, the present invention is applicable to any mark which is optically detected, for example an encoder mark (patterned mark), an address mark (sign), the calibration mark (pattern), etc.

A mark to which the present invention is applicable is not limited in color; the present invention is applicable to a mark which is not white in color, as well. That is, the present invention is compatible with a mark of any color, as long as the mark can provide optical contrast between the mark and the surface of an intermediary transfer member or recording medium conveying member, in the color range detectable by human eye, and also, in the infrared and ultraviolet color ranges. Further, the present invention is applicable to a mark having a mirror-like surface, a mark having various patterns, such as a bar code, a mark made up of dark and light areas, a mark in the form of a measuring tape long enough to be wrapped around an intermediary transfer member or recoding medium conveying member, or the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 113188/2007 filed Apr. 23, 2007 which is hereby incorporated by reference.

What is claimed is:

1. An image forming apparatus comprising:

an image bearing member for carrying a toner image;

toner image forming means for forming a toner image on said image bearing member;

detecting means for optically detecting a mark adhered on said image bearing member;

adjusting means for adjusting said toner image forming means on the basis of an output of said detecting means; and a protection sheet removably adhered to said mark, the protection sheet being capable of passing detecting light of said detecting means, wherein an adhesion of said protection sheet to said mark is smaller than an adhesion of said mark to said image bearing member, and wherein an adhesion of a leading portion of said protection sheet, with respect to a moving direction of said image bearing member, to said mark is smaller than an adhesion of a trailing portion of said protection sheet, with respect to the moving direction of said image bearing member, to said mark.

2. An apparatus according to claim 1, wherein said image bearing member has a belt shape and includes a supporting roller for supporting said image bearing member, and said mark is provided on an inner surface of said image bearing member.

3. An apparatus according to claim 1, wherein an area in which an adhesive material is applied on a mark side surface of said protection sheet to overlap with said mark is smaller than an area in which the adhesive material is applied on an image bearing member side surface of said mark to overlap with said protection sheet.

4. An apparatus according to claim 1, wherein an end of the trailing portion of said protection sheet is not overlapped on said mark and is adhered on said image bearing member.

5. An apparatus according to claim 1, wherein an area in which an adhesive material is applied in the leading portion of a mark side surface of said protection sheet is smaller than an area in which the adhesive material is applied in the trailing portion of the mark side surface of said protection sheet.

6. An apparatus according to claim 1, wherein an area in which an adhesive material is not applied on a mark side surface of said protection sheet reaches a leading side edge of the mark side surface of said protection sheet.

7. An apparatus according to claim 1, wherein a marker is provided in the leading portion of said protection sheet on a surface of said protection sheet remote from said mark.

8. An apparatus according to claim 1, wherein said detecting means detects, by a light receiving portion, light emitted by a light emitting portion and reflected by said image bearing member, wherein said apparatus is operable in a mode in which prior to an image forming operation after said protection sheet is removed, said detecting means operates a detecting operation while rotating said image bearing member, and an amount of light to be emitted by said light emitting portion is set on the basis of a result of detection of said detecting means.

9. An image forming apparatus comprising:

an image bearing member for carrying a toner image;

toner image forming means for forming a toner image on said image bearing member;

a first mark adhered to said image bearing member;

a second mark removably adhered to said first mark;

detecting means for optically detecting said first and second marks; and adjusting means for adjusting said toner image forming means on the basis of an output of said detecting means, wherein an adhesion of said second mark to said first mark is smaller than an adhesion of said first mark to said image bearing member.

10. An apparatus according to claim 9, wherein said image bearing member has a belt shape and includes a supporting roller for supporting said image bearing member, and said first and second marks are provided on an inner surface of said image bearing member, and wherein an adhesion of a leading portion of said second mark, with respect to a moving direction of said image bearing member, to said first mark is smaller than an adhesion of a trailing portion of said second mark, with respect to the moving direction of said image bearing member, to said first mark.

11. An apparatus according to claim 9, wherein an area in which the adhesive material is applied on a mark side surface of said second mark to overlap with said first mark is smaller than an area in which the adhesive material is applied on an image bearing member side surface of said first mark to overlap with said second mark.

12. An apparatus according to claim 9, wherein an end of the trailing portion of said second mark is not overlapped on said first mark and is adhered on said image bearing member.

13. An apparatus according to claim 9, wherein an area in which an adhesive material is applied in a leading portion of a first mark side surface of said second mark is smaller than an area in which the adhesive material is applied in a trailing portion of the first mark side surface of said second mark.

14. An apparatus according to claim 9, wherein an area in which an adhesive material is not applied on a first mark side surface of said second mark reaches a leading side edge of the first mark side surface of said second mark.

15. An apparatus according to claim 9, wherein a marker is provided in a leading portion of said second mark on a surface of said second mark remote from said first mark.

16. An apparatus according to claim 9, wherein said detecting means detects, by a light receiving portion, light emitted by a light emitting portion and reflected by said image bearing member, wherein said apparatus is operable in a mode in which prior to an image forming operation after said second mark is removed, said detecting means operates a detecting operation while rotating said image bearing member, and an amount of light to be emitted by said light emitting portion is set on the basis of a result of detection of said detecting means.

17. An image forming apparatus comprising:

an image bearing member for carrying a toner image;

toner image forming means for forming a toner image on said image bearing member;

detecting means for optical detecting a mark provided on said image bearing member;

adjusting means for adjusting said toner image forming means on the basis of an output of said detecting means;

a first protection sheet removably adhered to said mark, said first protection sheet being capable of passing a detecting light of said detecting means; and a second protection sheet removably adhered to said first protection sheet, said second protection sheet being capable of passing the detecting light of said detecting means, wherein an adhesion of said second protection sheet to said first protection sheet is smaller than an adhesion of said first protection sheet in the case of said mark.

18. An apparatus according to claim 17, wherein said image bearing member has a belt shape and includes a supporting roller for supporting said image bearing member, and said mark is provided on an inner surface of said image bearing member, and wherein an adhesion of a first portion of said second protection sheet, with respect to a moving direction of said image bearing member, to said first protection sheet is smaller than an adhesion of a trailing portion of said second protection sheet, with respect to the moving direction of said image bearing member, to said first protection sheet.

19. An apparatus according to claim 17, wherein an area in which the adhesive material is applied on a first protection sheet side surface of said second protection sheet to overlap with said first protection sheet is smaller than an area in which the adhesive material is applied on an image bearing member side surface of said first protection sheet to overlap with said second protection sheet.

20. An apparatus according to claim 17, wherein an end of a trailing portion of said second protection sheet is not overlapped on said first protection sheet and is adhered on said image bearing member.

21. An apparatus according to claim 17, wherein an area in which an adhesive material is applied in a leading portion of a first protection sheet side surface of said second protection sheet is smaller than an area in which the adhesive material is applied in a trailing portion of the first protection sheet side surface of said second protection sheet.

22. An apparatus according to claim 17, wherein an area in which an adhesive material is not applied on a first protection sheet side surface of said second protection sheet reaches a leading side edge of the first protection sheet side surface of said second protection sheet.

23. An apparatus according to claim 17, wherein a marker is provided in a leading portion of said second protection sheet on a surface of said second protection sheet remote from said first protection sheet.

24. An apparatus according to claim 17, wherein said detecting means detects, by a light receiving portion, light emitted by a light emitting portion and reflected by said image bearing member, wherein said apparatus is operable in a mode in which prior to an image forming operation after said second protection sheet is removed, said detecting means operates a detecting operation while rotating said image bearing member, and an amount of light to be emitted by said light emitting portion is set on the basis of a result of detection of said detecting means.

25. An image forming apparatus comprising:

an image bearing member for carrying a toner image;

toner image forming means for forming a toner image on said image bearing member;

a recording material carrying member for carrying a recording material;

transferring means for transferring a toner image from said image bearing member to a recording material carried on said recording material carrying member;

detecting means for optically detecting a mark adhered to said recording material carrying member;

adjusting means for adjusting said toner image forming means on the basis of an output of said detecting means; and a protection sheet removably adhered to said mark, said protection sheet being capable of passing detecting light of said detecting means, wherein an adhesion of said protection sheet to said mark is smaller than an adhesion of said mark to said recording material carrying member, and wherein an adhesion of a leading portion of said protection sheet, with respect to a moving direction of said recording material carrying member, is smaller than an adhesion of a trailing portion of said protection sheet, with respect to the moving direction of said recording material carrying member, to said mark.

26. An apparatus according to claim 25, wherein said recording material carrying member has a belt and includes a supporting roller for supporting said recording material carrying member, and said mark is provided on an inner surface of said recording material carrying member.

27. An apparatus according to claim 25, wherein an area in which the adhesive material is applied on a mark side surface of said protection sheet to overlap with said mark is smaller than an area in which the adhesive material is applied on a recording material carrying member side surface of said mark to overlap with said protection sheet.

28. An apparatus according to claim 25, wherein an end of the trailing portion of said protection sheet is not overlapped on said mark and is adhered on said recording material carrying member.

29. An apparatus according to claim 25, wherein an area in which an adhesive material is applied in the leading portion of a mark side surface of said protection sheet is smaller than an area in which the adhesive material is applied in the trailing portion of the mark side surface of said protection sheet.

30. An apparatus according to claim 25, wherein an area in which an adhesive material is not applied on a mark side surface of said protection sheet reaches a leading side edge of the mark side surface of said protection sheet.

31. An apparatus according to claim 25, wherein a marker is provided in the leading portion of said protection sheet on a surface of said protection sheet remote from said mark.

32. An apparatus according to claim 25, wherein said detecting means detects, by a light receiving portion, light emitted by a light emitting portion and reflected by said image bearing member, wherein said apparatus is operable in a mode in which prior to an image forming operation after said protection sheet is removed, said detecting means operates a detecting operation while rotating said image bearing member, and an amount of light to be emitted by said light emitting portion is set on the basis of a result of detection of said detecting means.

33. An image forming apparatus comprising:

an image bearing member for carrying a toner image;

a recording material carrying member for carrying a recording material;

transferring means for transferring a toner image from said image bearing member to a recording material carried on said recording material carrying member;

a first mark adhered to said recording material carrying member;

a second mark removably adhered to said first mark;

detecting means for optically detecting said first and second marks; and adjusting means for adjusting said toner image forming means on the basis of an output of said detecting means, wherein an adhesion of said second mark relating to said first mark is smaller than an adhesion of said first mark to said recording material carrying member.

34. An apparatus according to claim 33, wherein said recording material carrying member has a belt shape and includes a supporting roller for supporting said recording material carrying member, and said first and second marks are provided on an inner surface of said recording material carrying member, and wherein an adhesion of a leading portion of said first mark, with respect to a moving direction of said recording material carrying member, to said second mark is smaller than an adhesion of a trailing portion of said first mark, with respect to the moving direction of said image bearing member, to said second mark.

35. An apparatus according to claim 33, wherein an area in which the adhesive material is applied on a mark side surface of said second mark to overlap with said first mark is smaller than an area in which the adhesive material is applied on a recording material carrying member side surface of said first mark to overlap with said second mark.

36. An apparatus according to claim 33, wherein an end of a trailing portion of said second mark is not overlapped on said first mark and is adhered on said recording material carrying member.

37. An apparatus according to claim 33, wherein an area in which an adhesive material is applied in a leading portion of a first mark side surface of said second mark is smaller than an area in which the adhesive material is applied in a trailing portion of the first mark side surface of said second mark.

38. An apparatus according to claim 33, wherein an area in which an adhesive material is not applied on a first mark side surface of said second mark reaches a leading side edge of the first mark side surface of said second mark.

39. An apparatus according to claim 33, wherein a marker is provided in a leading portion of said second mark on a surface of said second mark remote from said first mark.

40. An apparatus according to claim 33, wherein said detecting means detects, by a light receiving portion, light emitted by a light emitting portion and reflected by said recording material carrying member, wherein said apparatus is operable in a mode in which prior to an image forming operation after said second mark is removed, said detecting means operates a detecting operation while rotating said recording material carrying member, and an amount of light to be emitted by said light emitting portion is set on the basis of a result of detection of said detecting means.

41. An image forming apparatus comprising:

an image bearing member for carrying a toner image;

a recording material carrying member for carrying a recording material;

transferring means for transferring a toner image from said image bearing member to a recording material carried on said recording material carrying member, detecting means for optically detecting a mark provided on said recording material carrying member;

adjusting means for adjusting said toner image forming means on the basis of an output of said detecting means;

a first protection sheet removably adhered to said mark, said first protection sheet being capable of passing detecting light of said detecting means; and a second protection sheet removably adhered to said first protection sheet, said second protection sheet being capable of passing the detecting light of said detecting means, wherein an adhesion of said second protection sheet to said first protection sheet is smaller than an adhesion of said first protection sheet to said mark.

42. An apparatus according to claim 41, wherein said recording material carrying member has a belt shape and includes a supporting roller for supporting said recording material carrying member, and said mark is provided on an inner surface of said recording material carrying member, and wherein an adhesion of a leading portion of said first mark, with respect to a moving direction of said recording material carrying member, to said second mark is smaller than an adhesion of a trailing portion of said first mark, with respect to the moving direction of said image bearing member, to said second mark.

43. An apparatus according to claim 41, wherein an area in which the adhesive material is applied on a first protection sheet side surface of said second protection sheet to overlap with said first protection sheet is smaller than an area in which the adhesive material is applied on a recording material carrying member side surface of said first protection sheet to overlap with said second protection sheet.

44. An apparatus according to claim 41, wherein an end of a trailing portion of said second protection sheet is not overlapped on said first protection sheet and is adhered on said recording material carrying member.

45. An apparatus according to claim 41, wherein an area in which an adhesive material is applied in a leading portion of a first protection sheet side surface of said second protection sheet is smaller than an area in which the adhesive material is applied in a trailing portion of the first protection sheet side surface of said protection sheet.

46. An apparatus according to claim 41, wherein an area in which an adhesive material is not applied on a first protection sheet side surface of said second protection sheet reaches a leading side edge of the first protection sheet side surface of said second protection sheet.

47. An apparatus according to claim 41, wherein a marker is provided in a leading portion of said second protection sheet on a surface of said second protection sheet remote from said first protection sheet.

48. An apparatus according to claim 41, wherein said detecting means detects, by a light receiving portion, light emitted by a light emitting portion and reflected by said recording material carrying member.

* * * * *